US005454192A

United States Patent [19]

Adler et al.

[11] Patent Number: 5,454,192

[45] Date of Patent: Oct. 3, 1995

[54] AUTOMATIC DOOR SWEEP

[75] Inventors: Richard S. Adler; Blake G. Sloan, both of New York, N.Y.; Keith T. O'Brien, Jacksonville, Fla.; Edwin L. Jesse, Toms River, N.J.

[73] Assignee: Richard S. Adler, New York, N.Y.

[21] Appl. No.: 83,101

[22] Filed: Jun. 25, 1993

[51] Int. Cl.[6] ..... E06B 7/20

[52] U.S. Cl. ..... 49/307; 49/309; 49/310

[58] Field of Search ..... 49/306, 307, 308, 49/309, 303, 310, 311, 482.1

[56] References Cited

U.S. PATENT DOCUMENTS

| | | | |
|---|---|---|---|
| 237,516 | 2/1881 | Gowen . | |
| 483,995 | 10/1892 | Delancy | 49/307 |
| 591,809 | 10/1897 | Brawley et al. . | |
| 639,026 | 12/1899 | Fernald . | |
| 639,831 | 12/1899 | Scoville . | |
| 728,686 | 5/1903 | Douden et al. . | |
| 746,910 | 12/1903 | Zimmermann | 49/309 |
| 1,460,312 | 6/1923 | Caron | 49/309 |
| 1,548,769 | 8/1925 | Thompson | 49/309 |
| 1,561,195 | 11/1925 | Szymkowiak . | |
| 1,771,599 | 7/1930 | Wilson | 49/309 |
| 1,843,350 | 2/1932 | Vedder . | |
| 1,978,761 | 10/1934 | Ramsay | 49/309 |
| 2,365,403 | 12/1944 | Galford . | |
| 2,422,607 | 6/1947 | Wynne . | |
| 2,587,567 | 2/1952 | Easton . | |
| 2,848,767 | 8/1958 | Thompson | 49/308 |
| 3,054,154 | 9/1962 | Henderson | 49/309 |
| 3,072,977 | 1/1963 | Burda | 49/307 |
| 3,281,990 | 11/1966 | Nilsson . | |
| 3,496,676 | 2/1970 | Halpern | 49/307 |
| 4,045,913 | 9/1977 | Wright . | |
| 4,089,136 | 5/1978 | Lapinski et al. . | |
| 4,320,793 | 3/1982 | Lindbergh . | |
| 4,528,775 | 7/1985 | Einarsson . | |
| 4,614,060 | 9/1986 | Dumenil et al. . | |
| 4,947,584 | 8/1990 | Wexler . | |
| 5,010,691 | 4/1991 | Takahashi | 49/482.1 |

FOREIGN PATENT DOCUMENTS

| | | | |
|---|---|---|---|
| 115066 | 5/1942 | Australia | 49/306 |
| 507977 | 1/1952 | Belgium | 49/306 |
| 525261 | 9/1952 | Canada | 49/308 |
| 664133 | 4/1929 | France | 49/306 |
| 841285 | 5/1939 | France . | |

OTHER PUBLICATIONS

Stanley Hardware Automatic Door Bottom Brochure (undated).

Macklanburg–Duncan Seal–O–Matic Door Bottom Brochure (undated).

*Primary Examiner*—Philip C. Kannan

*Attorney, Agent, or Firm*—Rosen, Dainow & Jacobs

[57] ABSTRACT

A sealing device automatically seals a gap between a door bottom and a floor in response to closing movement of the door. The sealing device includes a support element attachable to the door bottom, a seal actuating element movably supported from the support element by spring elements, and a sealing element carried by the seal actuating element. The sealing device may be mounted to the inside or outside of a door, or mortise-mounted in the door, and may be mounted to left- or right-opening hinged doors, or to sliding or articulated closures, and may be provided as an after market or OEM device. The spring elements in the preferred embodiment are one-piece and are integrally connected to both the support element and the seal actuating element, thereby forming a one-piece sealing device preferably made of plastic. In embodiments where lateral movement of the seal actuating element is required to seal the gap, a projection on the seal actuating element is engaged by a door jamb surface or an element attached thereto during door opening and closing. A cover for the device is attached without fasteners e.g., by snap-fitting or slide fitting, and may act as a kick plate, and may be decorative. The length of the sealing device may be easily reduced or expanded to fit various size doors. The invention also provides a device which holds the seal actuating element a predetermined distance from the support element during installation of the device on the door to facilitate installation.

48 Claims, 18 Drawing Sheets

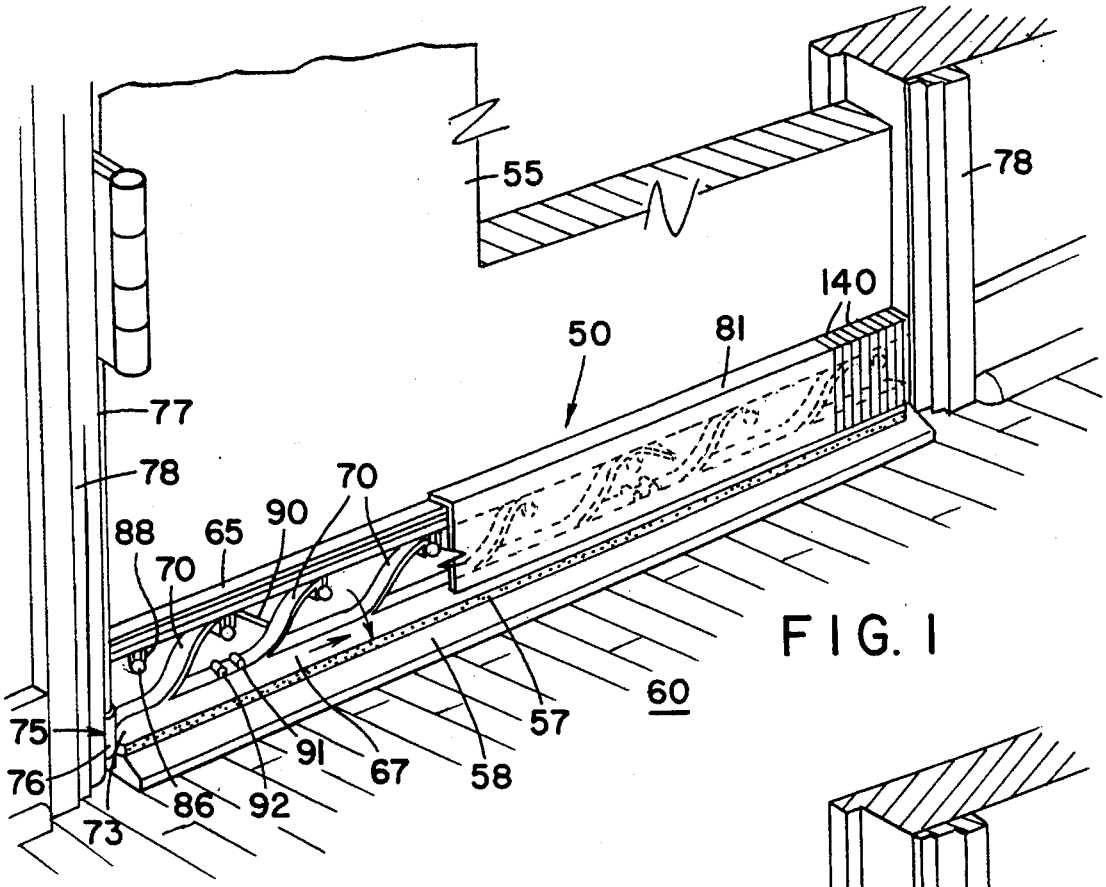
FIG. 1
FIG. 2
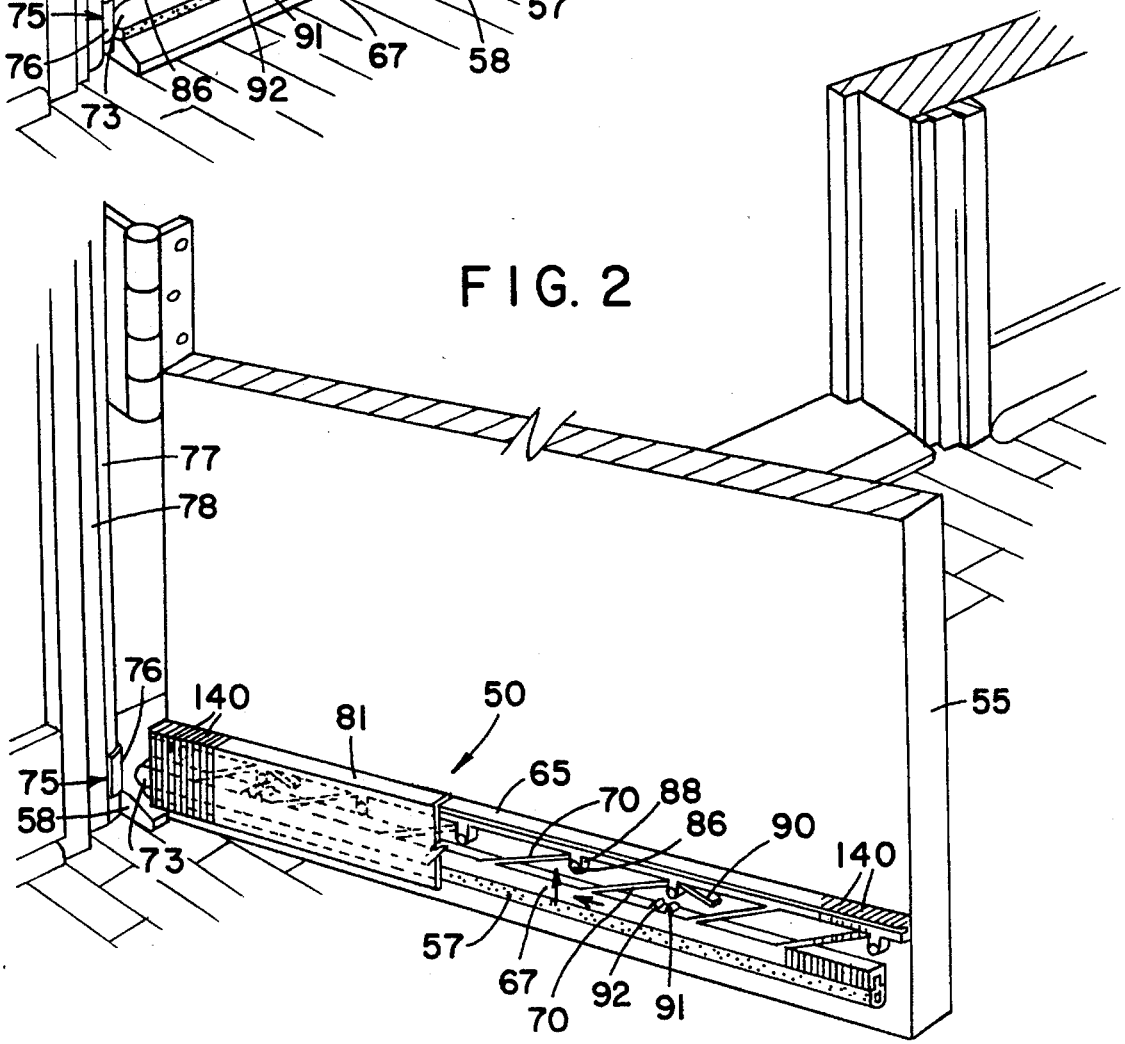

50
55
57
58
60
65
67
70
73
79
81
82
83
84
86
87
88
90
91
92

FIG. 7
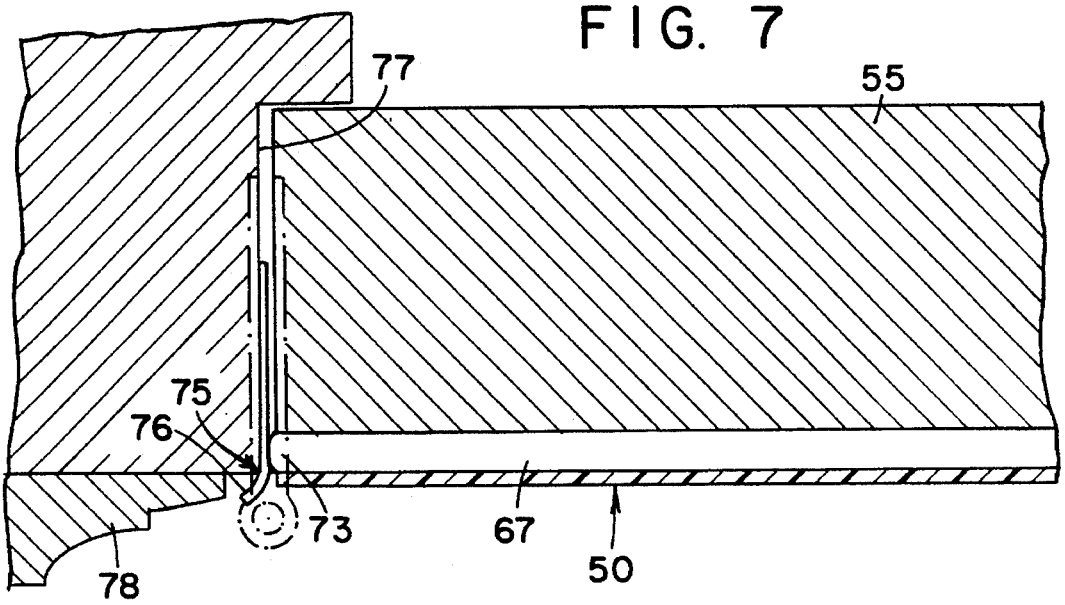
FIG. 9
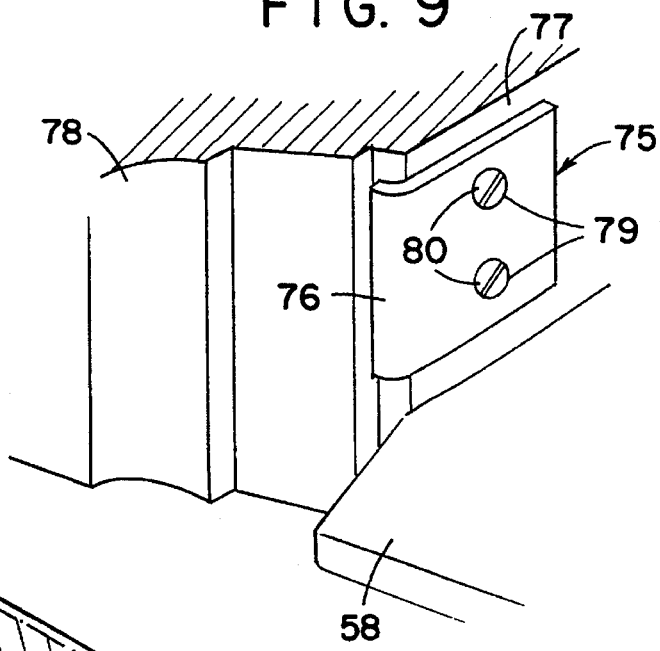
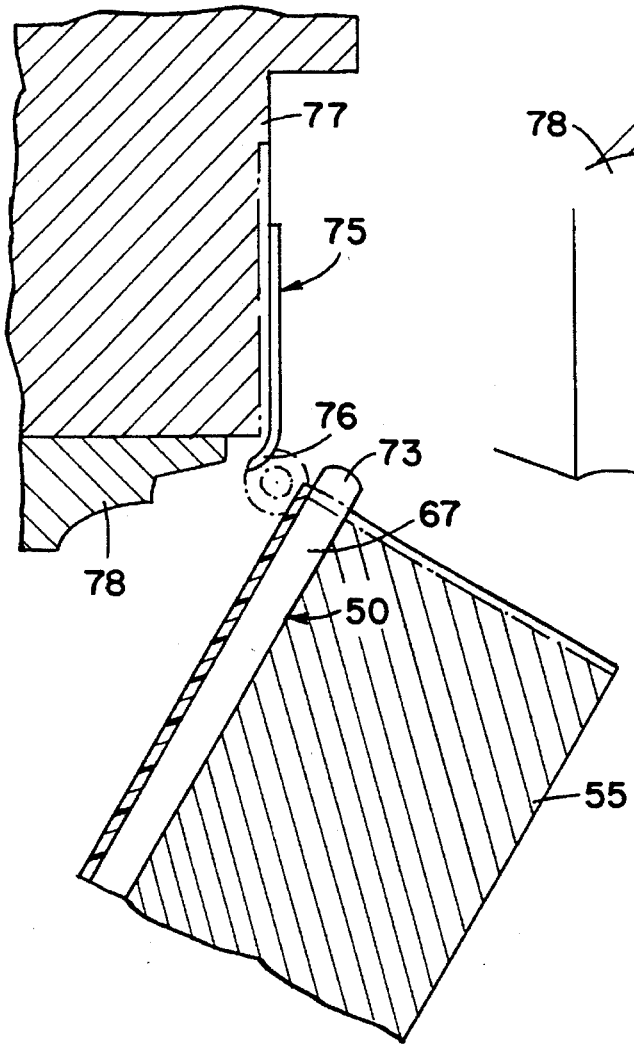
FIG. 8
FIG. 10
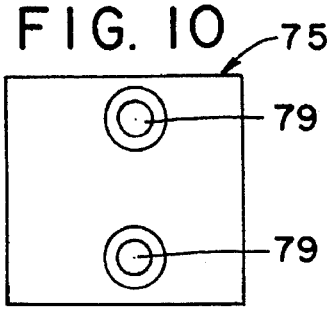

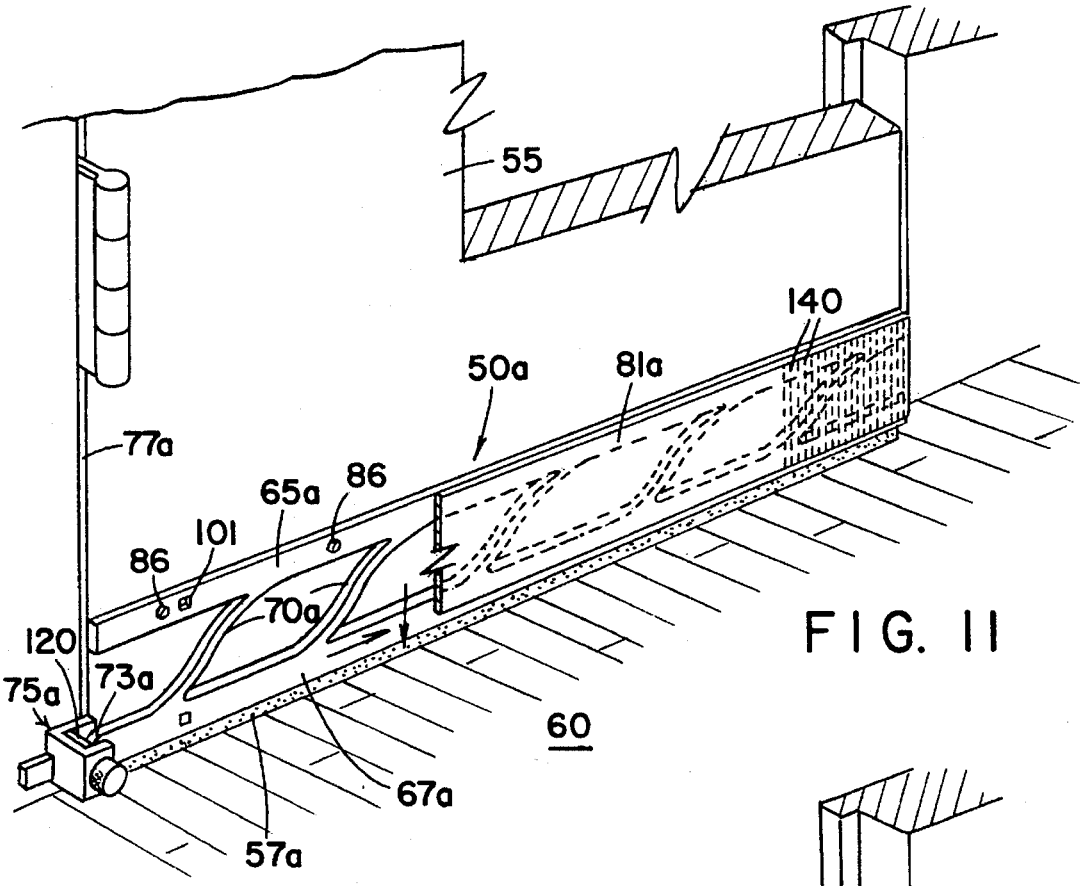
FIG. 11
FIG. 12
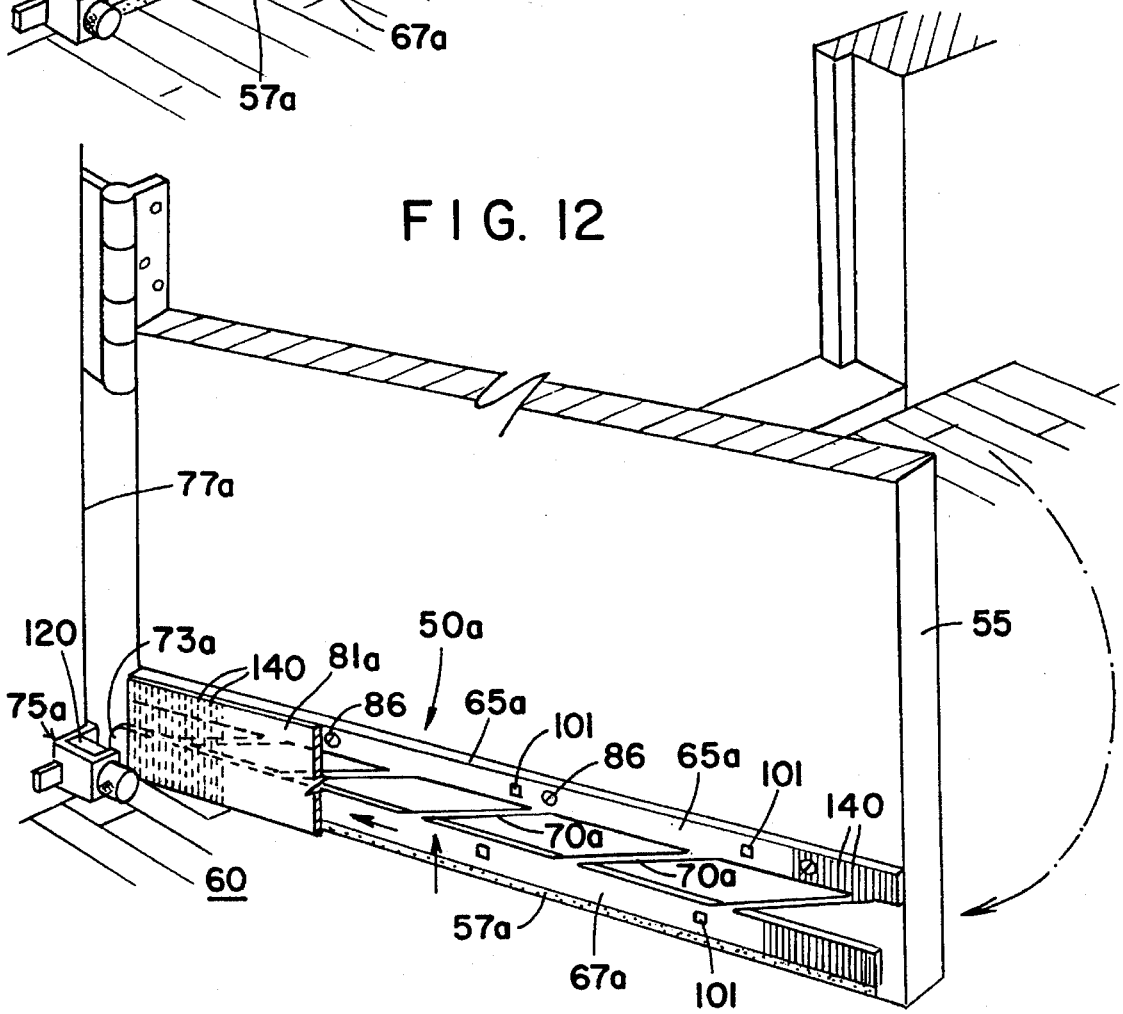

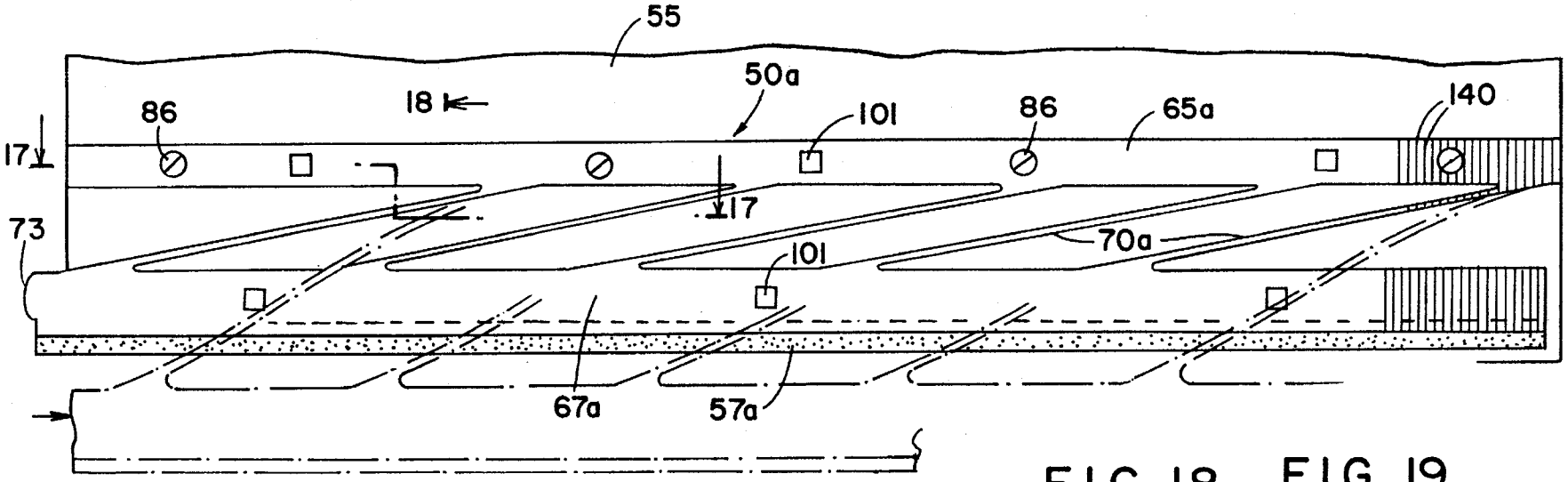
FIG. 16
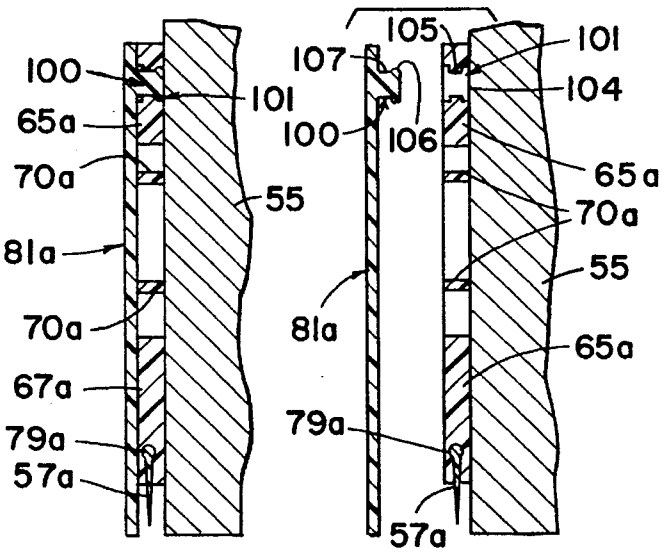
FIG. 18
FIG. 19
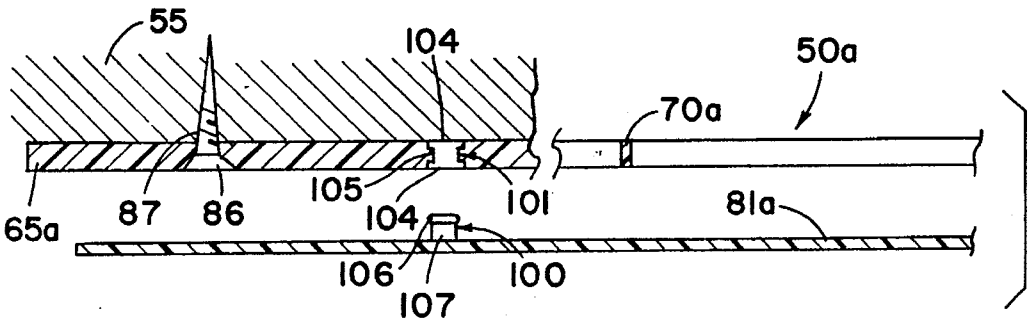
FIG. 17

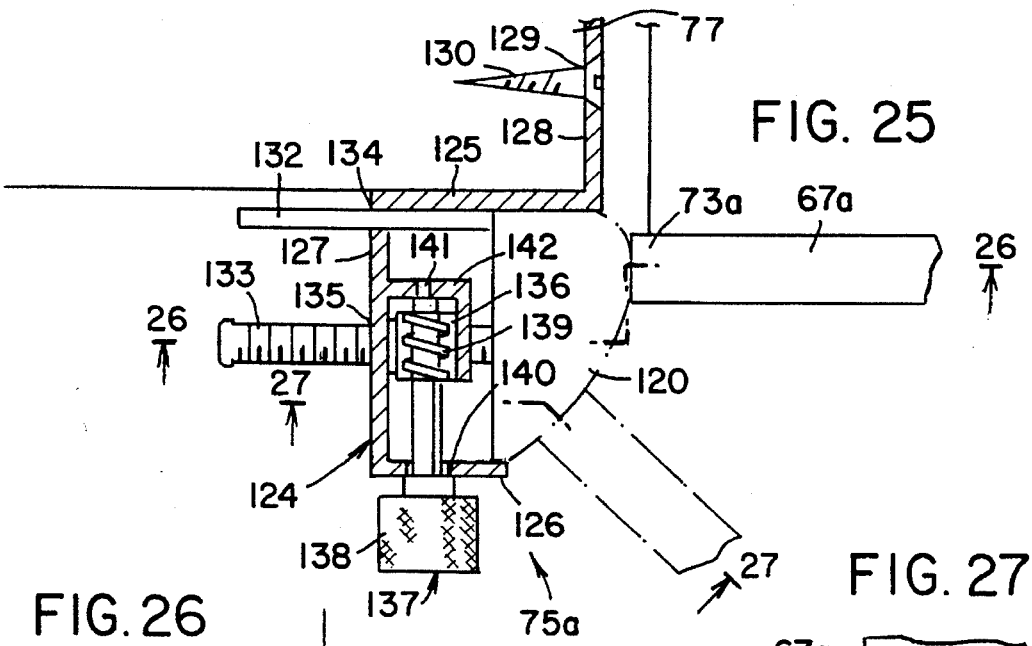
FIG. 25
FIG. 26
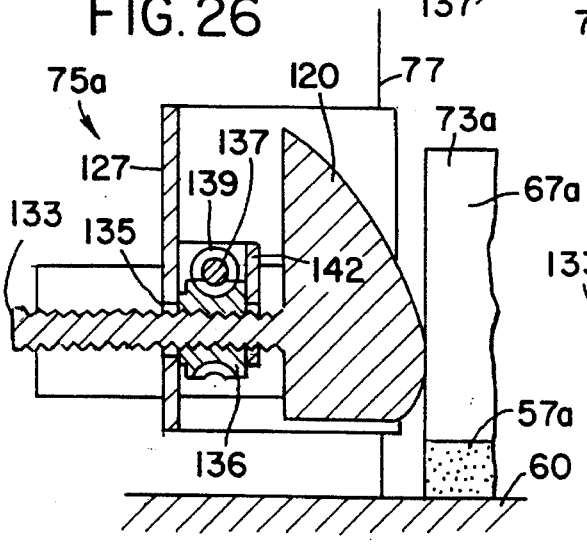
FIG. 27
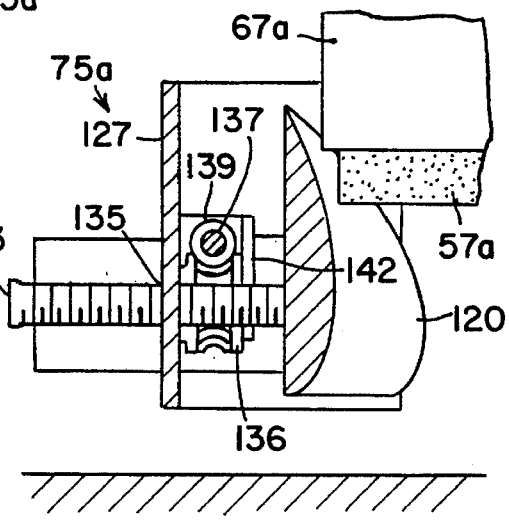
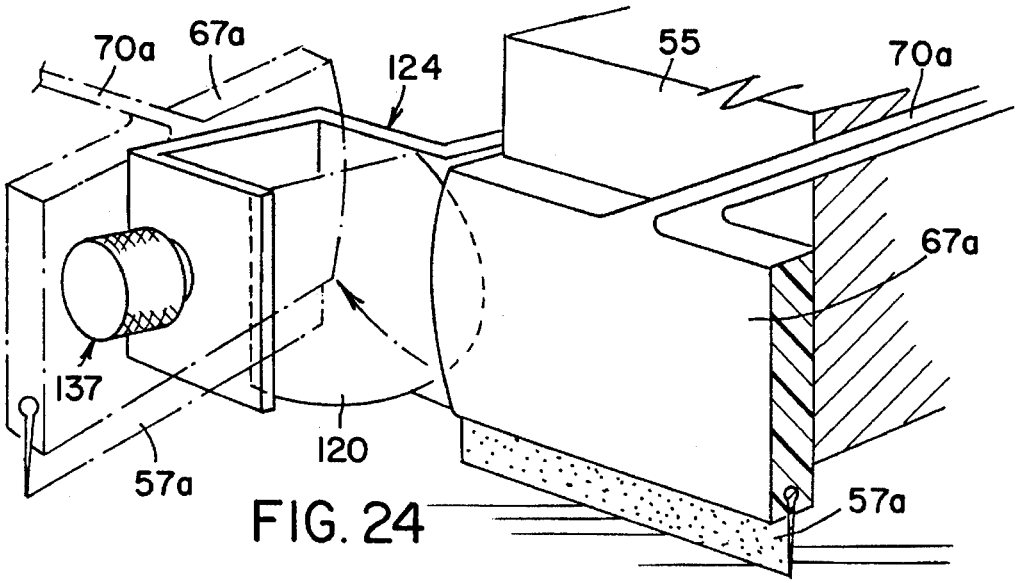
FIG. 24

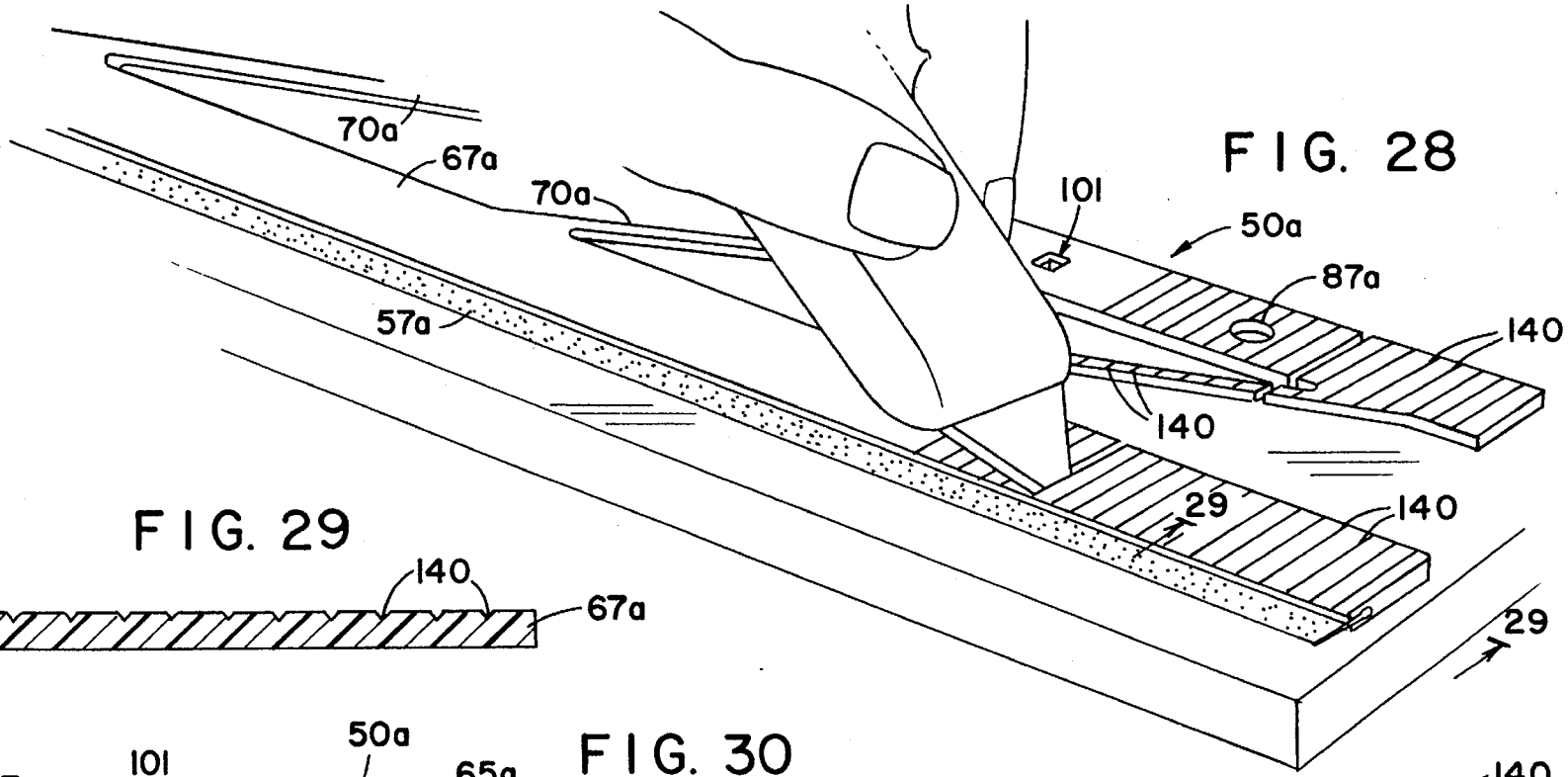
FIG. 28
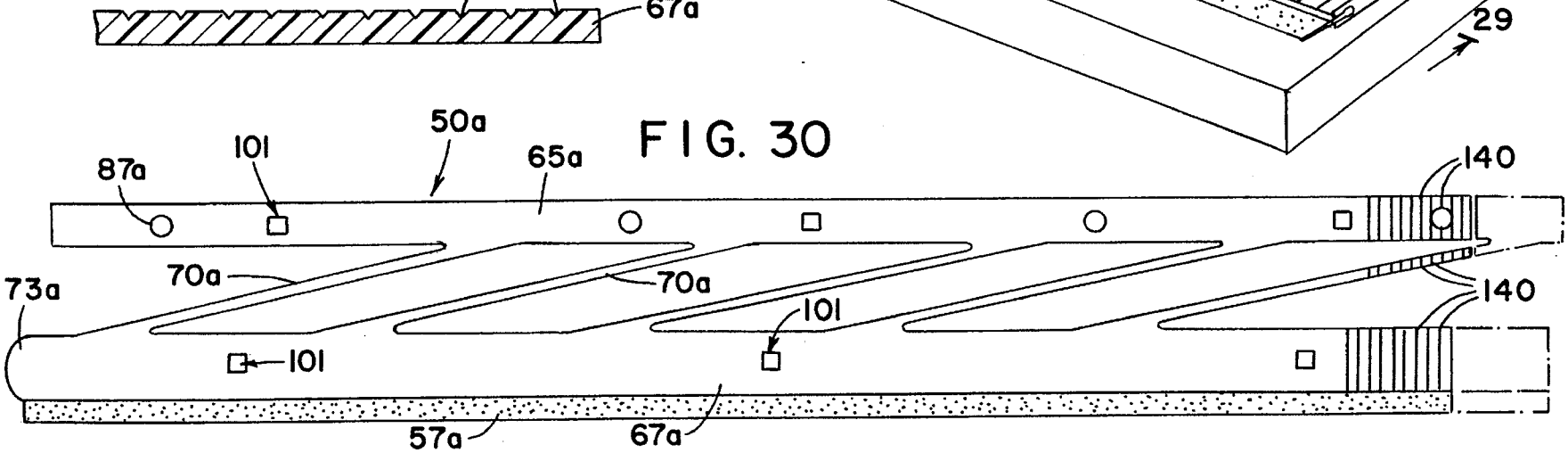
FIG. 30
FIG. 29

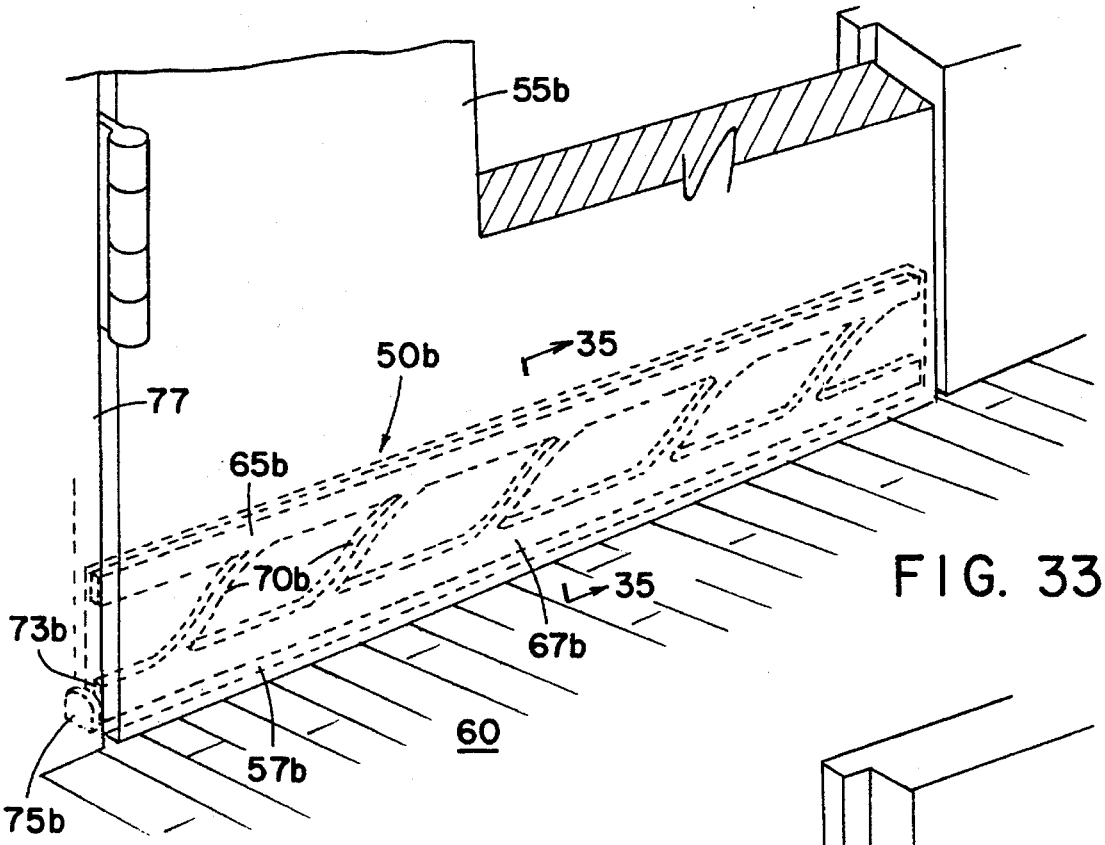
FIG. 33
FIG. 34
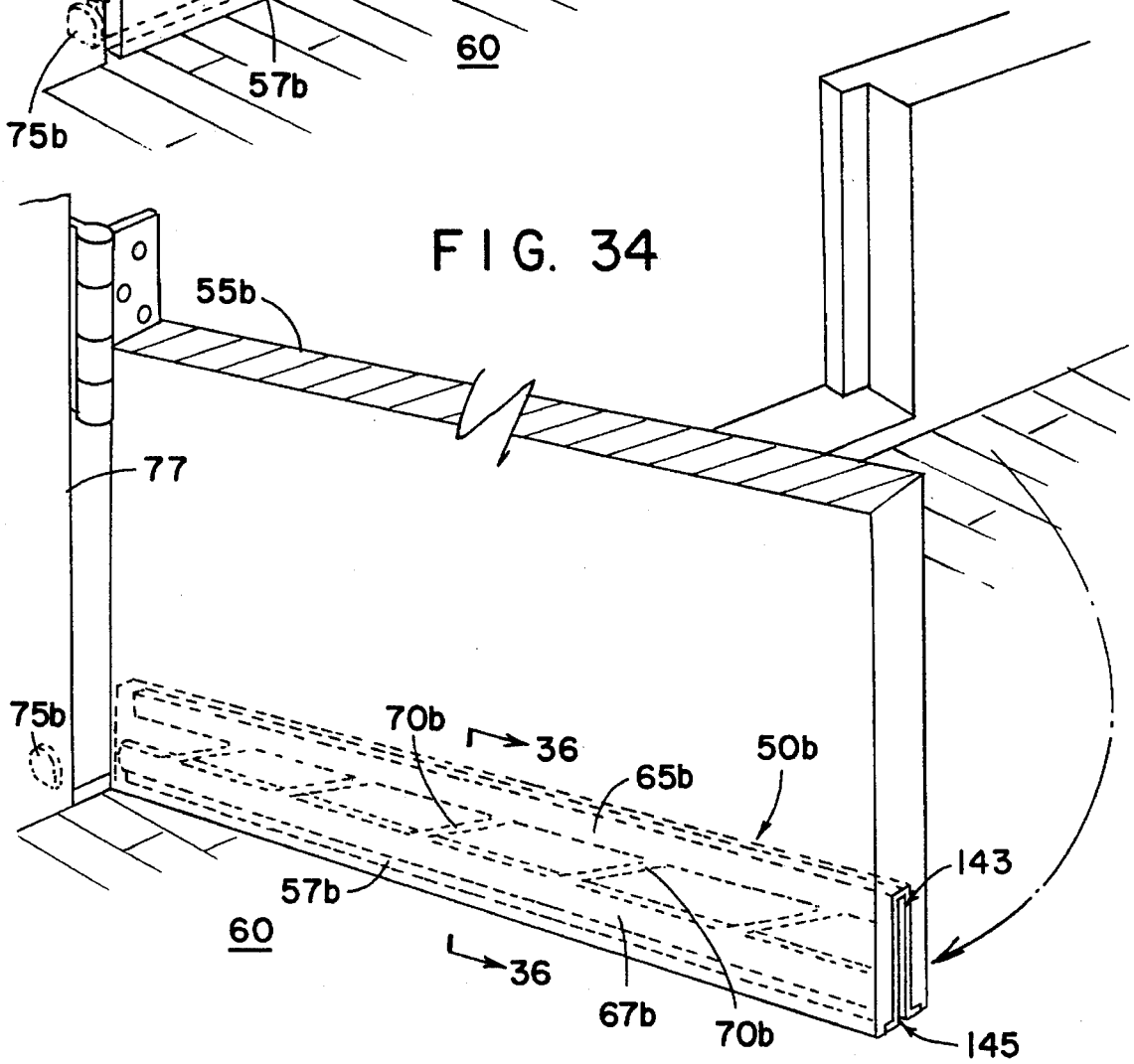

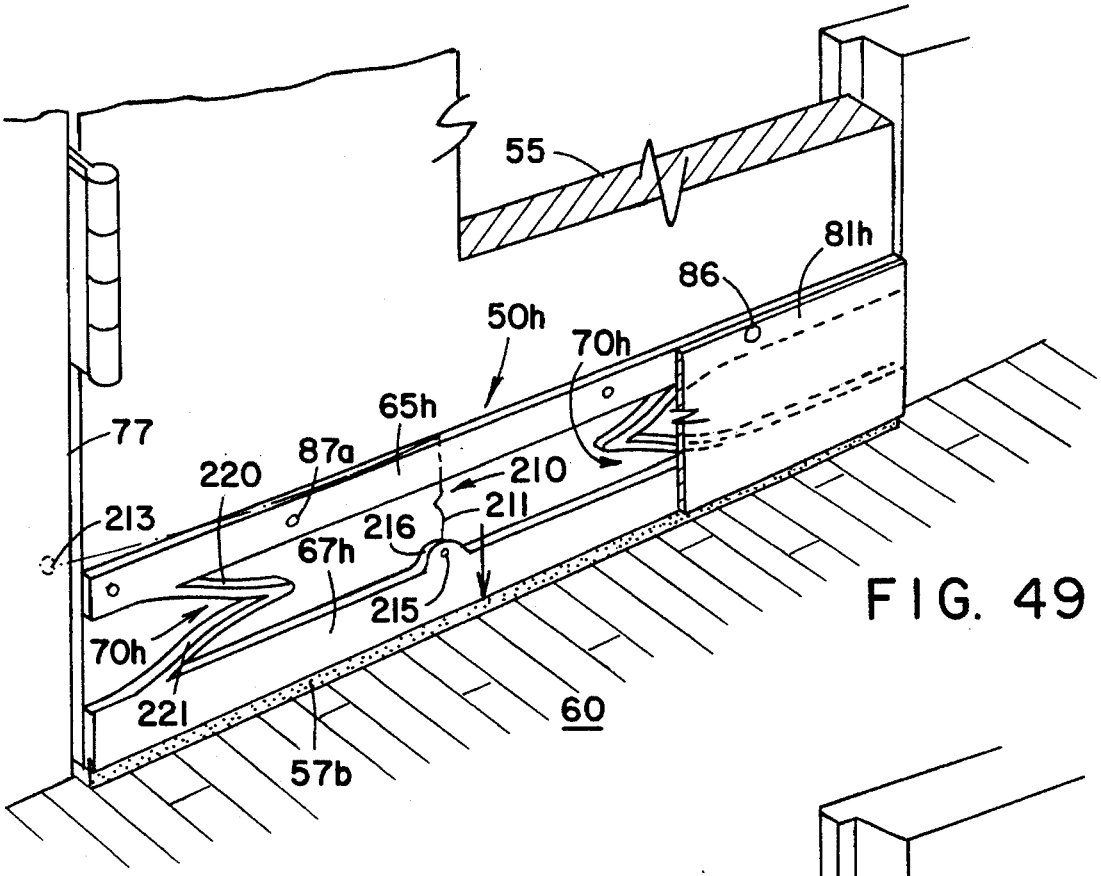
FIG. 49
FIG. 50
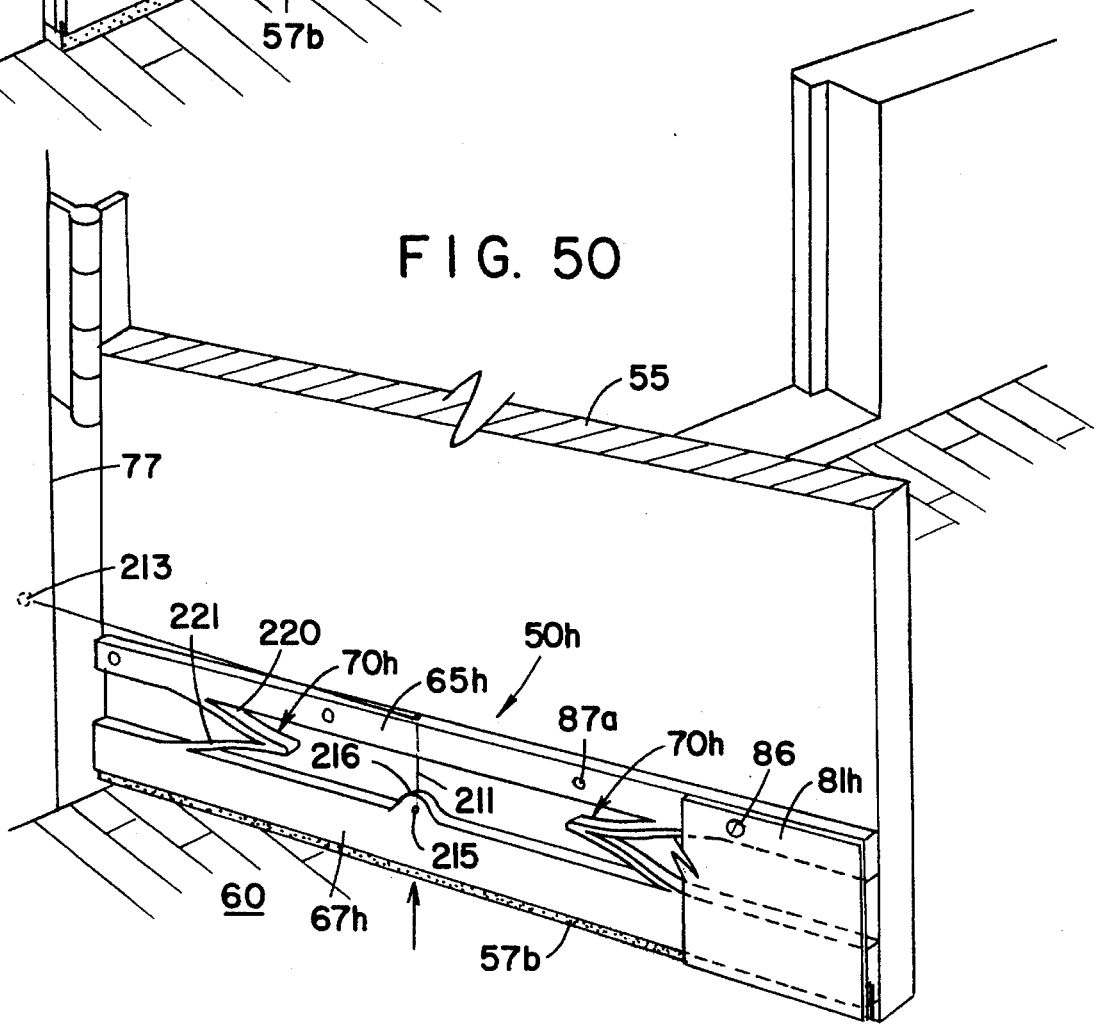

AUTOMATIC DOOR SWEEP

BACKGROUND OF THE INVENTION

The invention disclosed herein relates to a device attachable to a closure such as a door or window which automatically moves a sealing portion of the device to insulate a gap between the closure and the opening when the closure is moved to close the opening and which automatically moves the sealing portion away from the opening when the closure is moved to open the opening. Such devices when used to seal the gap at the bottom of a door may be referred to as an automatic door sweep or automatic door drop.

The following U.S. patents disclose devices attached to a door which automatically position a sealing portion thereof to contact a part of the opening closed by the door when the door is closed, and which move the sealing portion away from the opening when the door is opened: U.S. Pat. Nos. 237,516 (J. E. Gowen); 591,809 (D. A. Brawley et al.); 639,026 (J. C. Fernald); 639,831 (G. L. Scoville); 728,686 (E. Douden et al.); 1,561,195 (A. Szymkowiak); 1,843,350 (W. Vedder); 2,365,403 (E. H. Galford); 2,422,607 (F. C. Wynne); 3,281,990 (K. H. Nilsson); 4,045,913 (Wright); 4,320,793 (Lindbergh); 4,089,136 (Lapinski et al.); 4,528,775 (Einarsson); 4,614,060 (Dumenil et al.); 4,947,584 (Wexler); and in French Patent No. 841,285. Devices for automatically sealing a door bottom upon closing of the door are currently commercially available from Mackelanberg-Duncan of Oklahoma City, Okla. (as the "Door Sweep") and from Stanely. U.S. Pat. No. 2,587,567 (J. D. Easton) discloses a device for sealing louver blades on a louver window.

While such devices appear to more or less achieve the desired sealing function for the door, there is a need for a sealing device which, among other things, is inexpensive to manufacture, easy to install, fits or is adjustable to it various size openings, may seal against uneven surfaces, is durable and relatively slim, which can be attached to both left and right opening closures (e.g., doors and windows), and which can be mounted to the inside, outside or in an edge of the closure.

OBJECTS AND SUMMARY OF THE INVENTION

It is an object of the invention disclosed herein to provide an improved device for automatically sealing a closure such as a door or window against the opening closed by the closure by moving a sealing portion or element of the device against the opening in response to closing of the closure.

Another object of the invention is to provide such a device which is relatively inexpensive to manufacture and yet performs its sealing function well.

Another object of the invention is to provide such a device which is durable and will last for hundreds of thousands of openings and closings of the closure.

Another object of the invention is to provide such a device which is easy to install.

Another object of the invention is to provide such devices attachable either to any side or in any edge of the closure, and which can be used for the after market and the OEM market.

Another object of the invention is to provide such a device which can accommodate different size openings, for example, a device which may be reduced in length without the use of special tools to fit smaller openings and/or expanded in length without the use of special tools to fit larger openings.

Another object of the invention is to provide such a device which can operate with different thickness closures.

Another object of the invention is to provide such a device which can be mounted to both left-opening and right-opening closures.

Another object of the invention is to provide such a device which can be mounted to the inside of, the outside of, or in an edge of a closure.

Another object of the invention is to provide such a device which can seal an opening whether or not it is framed with moldings.

Another object of the invention is to provide such a device which seals against uneven surfaces of the opening.

Another object of the invention is to provide such a device which is slim and compact.

Another object of the invention is to provide such a device which operates with closures that are hinged to the opening or which articulate or slide relative to the opening such as a garage door.

Another object of the invention is to provide an esthetic cover for such a device.

Another object of the invention is to provide such a device in which a sealing element which seals the closure to the opening is replaceable.

The invention disclosed herein provides an automatically-actuated sealing device for a closure which includes a support element attachable to the closure, a seal actuating element movably supported by the support element, a sealing element moved by the seal actuating element into a sealing position, and a plurality of spring elements which couple the seal actuating element and the support element and in the closed position of the closure urge the seal actuating element towards the opening, thereby urging the sealing element into its sealing position against a portion or surface of the opening to seal the closure and the opening thereat.

Typically there is a gap between a closure and the opening it closes through which weather, dust, insects, etc. may pass. In the specific embodiments illustrated in the drawings, the seal actuating element moves from its sealing position, in which the sealing element is urged into contact with a portion or surface of the opening and closes the gap, to a non-sealing position in which the sealing element does not contact the opening in response to the opening of the closure. Via the spring elements, the support element resiliently supports the seal actuating element for movement relative to the support element towards and away from the support element, and the sealing element is attached to the device in engagement with the seal actuating element so as to move with movement of the seal actuating element. In the preferred embodiments, the seal actuating element is moved from a retracted non-sealing position in which the sealing element is retracted towards the support element and a projecting sealing position in which the seal actuating element is projected away from the support element in response to movement of the closure.

In various embodiments, the sealing device may be mounted to or in any edge of the closure, and to the inside of, or the outside of the closure, and the sealing device may be mounted to left- or right-opening hinged closures, or to sliding or articulated closures, and may be provided as an after market or OEM device.

The spring elements not only support the seal actuating element from the support element, they also actively participate in moving the seal actuating element between its sealing and nonsealing positions. The sole coupling between the support element and the seal actuating element is through the spring elements. Use of the spring elements for both support and movement of the seal actuating element simplifies construction of sealing devices according to the invention.

The spring elements are spaced apart and project transversely from a same side of the support element and/or seal actuating element. In various embodiments, the spring elements may be one-piece and integrally connected to both the support element and the seal actuating element, thereby forming a one-piece sealing device; or the spring elements may be one-piece and integrally connected to either the support element or the seal actuating element and coupled to the seal actuating element or the support element, respectively; or the spring elements may be two-piece, with a different piece being integrally connected to the support element and the seal actuating element and the two separate pieces of the spring elements coupled together; or the spring elements may be one-piece and coupled to both the support element and the seal actuating element.

In the preferred embodiments, the support element, the seal actuating element and the spring elements are made entirely of plastic material, for example, made by injection molding, or by die cutting pre-formed sheets. As presently preferred, the sealing device is made injection molded in one piece with the spring elements integrally connected to both the support element and the seal actuating element. The plastic material is preferably one that does not substantially affect performance of the device over a wide temperature range so that the device may be mounted to the outside (weather side) of a closure. In the preferred embodiment, the plastic material is copolymer polypropylene, which is currently used extensively for so-called living hinges.

The sealing device in different embodiments may be constructed such that the spring elements are stressed in the open position of the closure and relatively relaxed in the closed position of the closure, and vice versa. In the embodiments in which all or part of the spring elements are integrally connected to the support element and/or the seal actuating element, the spring elements may be molded "long", resulting in them being unloaded or relaxed when the closure is closed, and loaded or stressed when the closure is opened; or they may be molded "short" resulting in them being loaded or stressed when the closure is closed and unloaded or unstressed when the closure is opened. In the molded-long condition, the spring element are in their naturally relaxed, long position, which reduces creep of the springs since the closure generally remains closed over long periods. It is preferable if the sealing device can be constructed so that the spring element are relaxed in the closed position of the closure since typically a closure will be closed most of the time and this construction will increase the service life of the sealing device. However, depending upon the particular embodiment of the sealing device and the location at which it is mounted to the closure, the preferred construction is not always possible.

In the embodiments in which the spring elements are not one piece or not integrally connected to the support element or the seal actuating element, interlocking structure is provided for coupling the spring elements to each other or the support element and/or the seal actuating element such that the support element supports the seal actuating element for movement relative to the support element and urges the sealing element into contact with the opening as described above. Such interlocking structure does not require the use of fasteners for coupling the spring elements. Preferably, the spring elements, the support element and the seal actuating element are assembled such that the spring elements are not stressed in the closed position of the closure.

In one embodiment, the sealing device comprises a first one-piece member comprising an elongated support element attachable to the closure member and a plurality of spaced first spring elements connected at one end to the support element and projecting transversely therefrom; a second one-piece member comprising a seal actuating element and a second plurality of spaced spring elements connected at one end to the support element and projecting transversely therefrom; and the interlocking structure described above for the spring elements.

Sealing devices according to the invention operate by coupling the device to the opening so that opening and closing of the closure generates movement of the seal actuating element. Means are therefore provided for coupling the seal actuating element to the opening or to an element coupled to the opening to move the seal actuating element relative to the support element.

In some embodiments, the spring elements are configured and connected such that lateral movement of the seal actuating element in one direction moves the seal actuating element away from the support element and lateral movement in an opposite direction moves the seal actuating element towards the support element. In those embodiments, the means for coupling and the spring elements cooperate to laterally move the seal actuating element between the nonsealing retracted position and the projecting sealing position, and the spring elements are stressed in the closed position of the closure. The means for coupling may comprise a projection or cam follower on the seal actuating element adapted to be engaged by the opening (e.g., a door jamb) or a bearing element or cam element coupled to the opening, during opening and closing of the closure. When the closure is closed, the projection bears against the opening or element and causes the seal actuating element to be moved laterally in one direction into the projecting sealing position thereof. In the projecting sealing position of the device, the support element and the sealing element are aligned. When the closure is moved from the closed position thereof, the projection is adapted to move out of contact with the opening or element to cause the seal actuating element to move in the opposite lateral direction to the retracted nonsealing position thereof, in which the seal actuating element is offset from the support element approximately by the length of the projection.

The coupling means may comprise the edge of the opening, or a bearing element or cam element mounted to or adjacent to the edge of the opening against which the projection on the seal actuating element bears. Depending on whether the inventive sealing device is attached to the inside of, the outside of, or in the closure, the bearing element or cam element may be located on the hinge side of a hinged closure or the opposite side, and may be located on the edge of the opening or projecting from the edge of the opening. Whether or not the opening is framed with moldings will also determine the location of the bearing element or cam element. Preferably, the bearing element or cam element is made adjustable to facilitate installation of the sealing device. The cam element's adjustability can also compensate for wear, plastic creep and/or other changes in the sealing device and closure.

In the preferred embodiments, the cam element is provided attached to the hinged side of the interior (non-weather side) of the opening to be engaged by the projection on the seal actuating element for camming the seal actuating element to progressively move the seal actuating element laterally in opposite directions as the closure is moved into and out of its closed position. In one embodiment, the cam element has camming surfaces extending in two directions so as to cam the seal actuating element laterally and towards and away from the support element. The configurations of the cam element and projection affect the speed with which the seal actuating element is moved during opening and closing of the closure. Preferably, the seal actuating element is quickly moved out of contact with the opening as the closure is opened, and makes contact with the opening at the last possible moment when the closure is closed. This is particularly advantagous for a sealing device mounted to a door bottom which moves over carpeting so that the sealing element is quickly raised above the top of the carpeting pile when the door is opened.

In another embodiment of the sealing device, only two spring elements are configured, which direct movement of the seal actuating element towards and away from the support element while restraining lateral movement of the seal actuating element. The means for coupling the sealing device to the opening and the spring elements cooperate to move the seal actuating element towards and away from the support element with substantially no lateral movement of the seal actuating element. In this embodiment, the spring elements are unstressed in the closed position of the closure, and the means for coupling comprises an elongated flexible element with one end attached to the seal actuating element and the other attached to the opening, which moves the seal actuating element from the projecting sealing position to the retracted non-sealing position.

The support element may be mounted on the outside of, or the inside of the closure, and a cover is provided to cover all of the support element and all or substantially all of the seal actuating element while permitting movement of the seal actuating element. The cover may act as a kick plate, and/or may be decorative, etc. Preferably, means are provided for attaching the cover to the sealing device or closure without fasteners e.g., means for snap-fitting the cover to the support element or the closure or means which engage as the cover is slid onto the sealing device or door.

In another embodiment, the sealing device is mounted within the closure. In that embodiment, which may be referred to a "mortise mounted" sealing device, a channel member is provided and means attach the support element within the channel member while permitting movement of the seal actuating element within the channel with the same motion as described above. In this embodiment, the coupling means may comprise a bearing element or cam element attached to the edge of the opening, e.g., a door jamb.

In accordance with the invention, the sealing device may be provided with means for easily reducing or expanding the length thereof to fit various size closures. In an embodiment in which the length of the sealing device may be reduced, the sealing device is provided large enough to fit a predetermined large opening, and means are provided for easily reducing the length of the sealing device to fit smaller openings. In that embodiment, the support element, the spring elements and the seal actuating element have a plurality of laterally spaced, aligned pre-weakened portions adjacent at least one end of the device by means of which the device may be severed easily along the aligned pre-weakened portions by stressing, cutting, or the like along the aligned pre-weakened portions.

In an embodiment in which the length of the sealing device may be extended, modules of the sealing device may be provided which are easily joined together to modularly expand the device. One or more of the modules may be reducible in length as discussed above. For example, a base sealing device and one or more extension sealing sections may be provided. The support element and the seal actuating element of the base sealing device include at at least one end thereof means for connecting thereto the support element and seal actuating element, respectively, of the extension sealing section. In that embodiment, pegs or projections on one of the devices may be friction fitted into respective hollow ends of the other section to join the respective base sealing device and extension section.

The sealing device according to the invention is constructed so that it may be mounted to either a right-opening or a left-opening closure simply by reversing the sealing device end-to-end. Therefore, in embodiments which include a projection which bears on a cam element, bearing member or the opening, the pre-weakened portions are provided only at the end of the sealing device without the projection so that the device may only be severed at that one end. However, such a sealing device is capable of being mounted to right-opening or left-opening closures simply by reversing the device end-to-end. While embodiments in which the coupling means do not include a projection may have pre-weakened portions at both ends, the pre-weakened portions are preferably provided only at one end in order to increase the length by which the sealing device may be reduced, as described below.

The cover for all embodiments is symmetrical about its center line so that it may be used for sealing devices mounted to either a left-opening or a right-opening closure. Separate covers may be provided for the base sealing device and the extension section of the modularly expandable device which butt against each other, giving the appearance of a single cover.

In one embodiment, the seal actuating element comprises a plurality of specially shaped and specially connected members extending laterally relative to the support element flexibly interconnected or articulated such that at least one of the members of the seal actuating element may move or bend independent and relative to an adjacent member, whereby when the closure member is in its closed position, the seal actuating element may move the sealing element into sealing engagement with an inclined or uneven surface.

The invention also provides a means for facilitating mounting of the sealing device to a closure. Such means hold the seal actuating element a predetermined distance from the support element during installation of the device on the closure member. In the preferred embodiments, at least one spacer element is provided which engages both the support element and the seal actuating element under action of the spring elements to maintain the support element and the seal actuating element a predetermined distance apart. In one embodiment, the spacer element is integral with and pivotally attached to the support element and may be pivoted to engage one or more projections on the seal actuating element (or vice versa). In another embodiment, the spacer element is removable and is engaged by means of spaced projections on the spacer element and holes in the support and seal actuating elements (or vice versa). The sealing device may be used as a template to mark holes in the closure which can be predrilled to accept screws by means of which the sealing device may be mounted to the closure.

The sealing devices disclosed herein may be provided as after market devices, even the mortise mounted sealing device for "handy" and skilled persons, and as OEM devices.

BRIEF DESCRIPTION OF THE DRAWINGS

The invention is illustrated in the figures of the accompanying drawings which are meant to be exemplary and not limiting, in which like numerals refer to like or corresponding parts, and in which:

FIG. 1 is a front perspective view of a sealing device according to the invention, with the cover partially broken away, mounted to the bottom of a door on the inside thereof, in which the door is shown in its closed position and the sealing device is shown with its sealing element in its projecting sealing position contacting a saddle below the door;

FIG. 2 is a view similar to that of FIG. 1 with a different part of the sealing device broken away and showing the door partially opened and the sealing element of the device in a retracted non-sealing position out of contact with the saddle and the floor;

FIG. 7 is a horizontal section view taken along different lines through the sealing device, closed door, door jamb and molding shown in FIG. 1;

FIG. 8 is a horizontal section view taken along different lines through the sealing device, opened door, door jamb and molding shown in FIG. 2;

FIG. 9 is a perspective view of the lower part of the hinge side of the door jamb and the hinge side of the floor saddle shown in FIG. 1, with the door removed, showing a cam element;

FIG. 10 is a front elevation view of the cam element depicted in FIG. 9;

FIG. 11 is a front perspective view of a sealing device according to another embodiment of the invention, with the cover partially broken away, mounted to the bottom of a door on the inside thereof, in which the door is shown in its closed position and the sealing device is shown with its sealing element in its projecting sealing position contacting the floor below the door;

FIG. 12 is a view similar to that of FIG. 11 of the sealing device of FIG. 11 with a different part of the sealing device broken away and showing the door partially opened and the sealing element of the device in a retracted non-sealing position out of contact with the floor;

FIG. 16 is a front elevation view of the sealing device and door of FIG. 11 illustrating movement of the seal actuating and sealing elements of the sealing device from the full line position when the door is partially or fully opened as in FIGS. 12 and 15 to the broken line position when the door is closed as in FIGS. 11, 13 and 14;

FIG. 17 is a section view of the sealing device and door of FIG. 11 taken along line 17—17 in FIG. 16;

FIG. 18 is a section view of the sealing device and door of FIG. 11 taken along line 18—18 FIG. 16;

FIG. 19 is an exploded side sectional view of the sealing device and door of FIG. 18 but with the cover of the sealing device separated from the sealing device;

FIG. 24 is a perspective view of another embodiment of a cam element employed with the sealing device of FIG. 11 showing a part of the sealing device of FIG. 11 with the door in the closed position;

FIG. 25 is a top view of the cam element and sealing device of FIG. 24 showing the door in its closed position and a partially open position;

FIG. 26 is a section view of the cam element and sealing device of FIG. 24 taken along line 26—26 in FIG. 25;

FIG. 27 is a section view of the cam element and sealing device of FIG. 24 taken along line 27—27 in FIG. 25;

FIG. 28 is a front perspective view of the sealing device of FIG. 11 without the cover prior to installation illustrating adjustment of the length of the device by severing an end of the device along one of a plurality pre-weakened portions of the device;

FIG. 29 is a section view of the sealing device as shown in FIG. 28 taken along line 29—29 in FIG. 28;

FIG. 30 is a front elevation view of the sealing device shown in FIG. 29 in which broken lines indicate the device before the end thereof is severed and solid lines indicate the device after the end thereof is severed;

FIGS. 33 and 34 are front perspective views of an embodiment of a mortise mounted sealing device according to the invention which is mounted within the bottom of the door, FIG. 33 showing the sealing device with its sealing element in its projecting sealing position in contact with the floor in the closed position of the door and FIG. 34 showing the sealing element in its retracted non-sealing position out of contact with the floor in a partially open position of the door;

FIG. 49 is a front perspective view of another embodiment of a sealing device according to the invention mounted to a door, in which the movable part of the device is coupled to the door jamb differently than in the embodiment of FIG. 1, shown with the cover broken away and the door in its closed position with the sealing element in its projecting sealing position in contact with the floor; and FIG. 50 is a front perspective view of the sealing device and door of FIG. 49 shown with the door partially opened and the sealing element of the device in its retracted non-sealing position out of contact with the floor.

DESCRIPTION OF THE PREFERRED EMBODIMENTS

The drawings illustrate embodiments of sealing devices according to the invention for a closure in the form of a door, specifically, a door which pivots to open and close an opening. The drawings further illustrate that the sealing devices are attached to the bottom of the door and seal the door to a floor which defines part of the opening. However, the invention is applicable to: closures other than doors, e.g., windows; to closures than those which pivot, e.g., sliding closures such as garage doors and pocket doors; and to sealing the sides and or the top of a closure as well as the bottom of the closure.

Figures 3, 4, 5, 6:
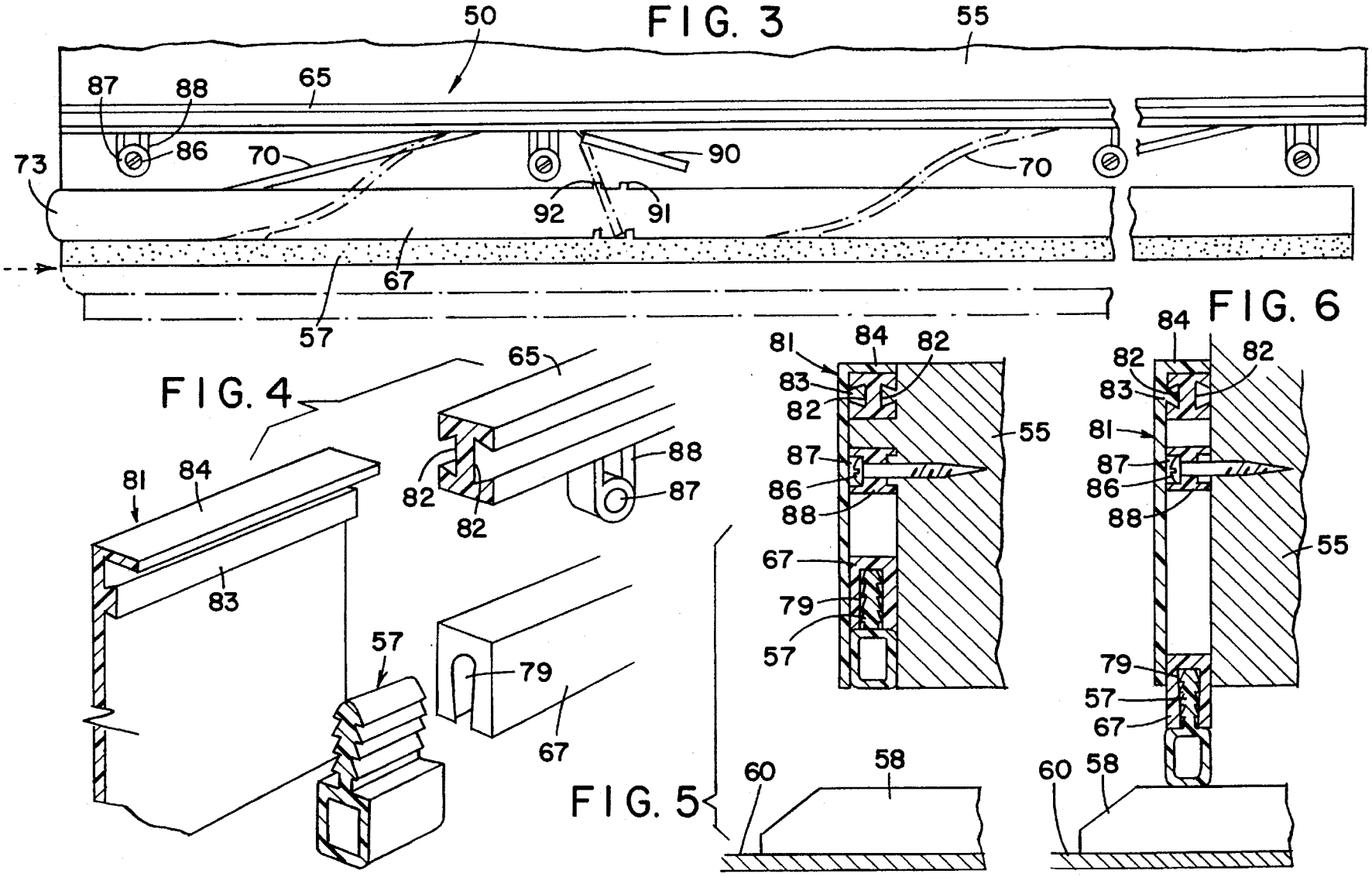
FIG. 3 is a front elevational view of the sealing device of FIG. 1 mounted to the bottom of the door showing in solid lines the sealing element in its retracted non-sealing position and in broken lines the sealing element in its projecting sealing position.
FIG. 4 is an exploded perspective and section view of the sealing device of FIG. 1.
FIG. 5 is a vertical section view of the sealing device and door of FIG. 2 taken with the door opened.
FIG. 6 is a vertical section view of the sealing device and door of FIG. 1 taken with the door closed.
Figure 14:
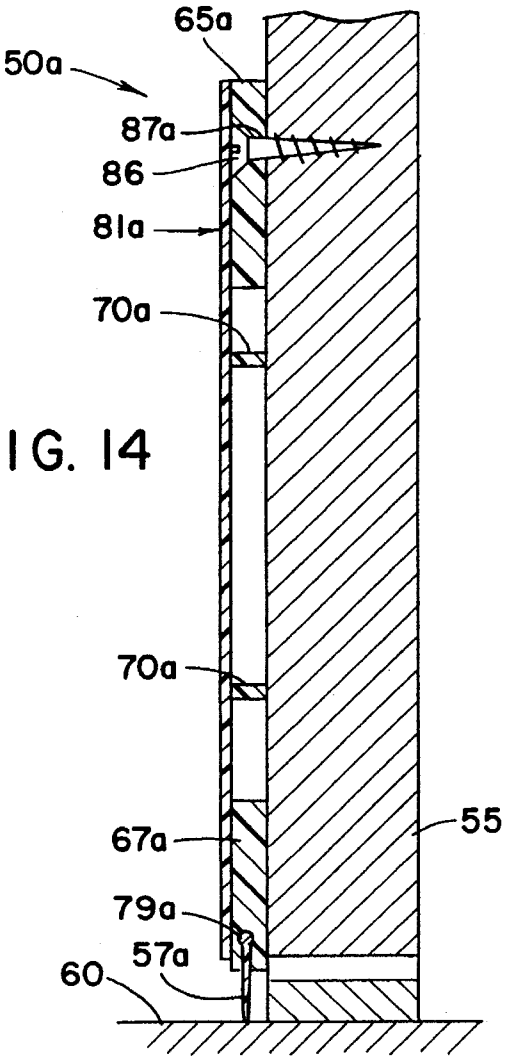
FIG. 14 is a vertical section view of the sealing device and door of FIG. 11 taken with the door closed.
Figure 40:
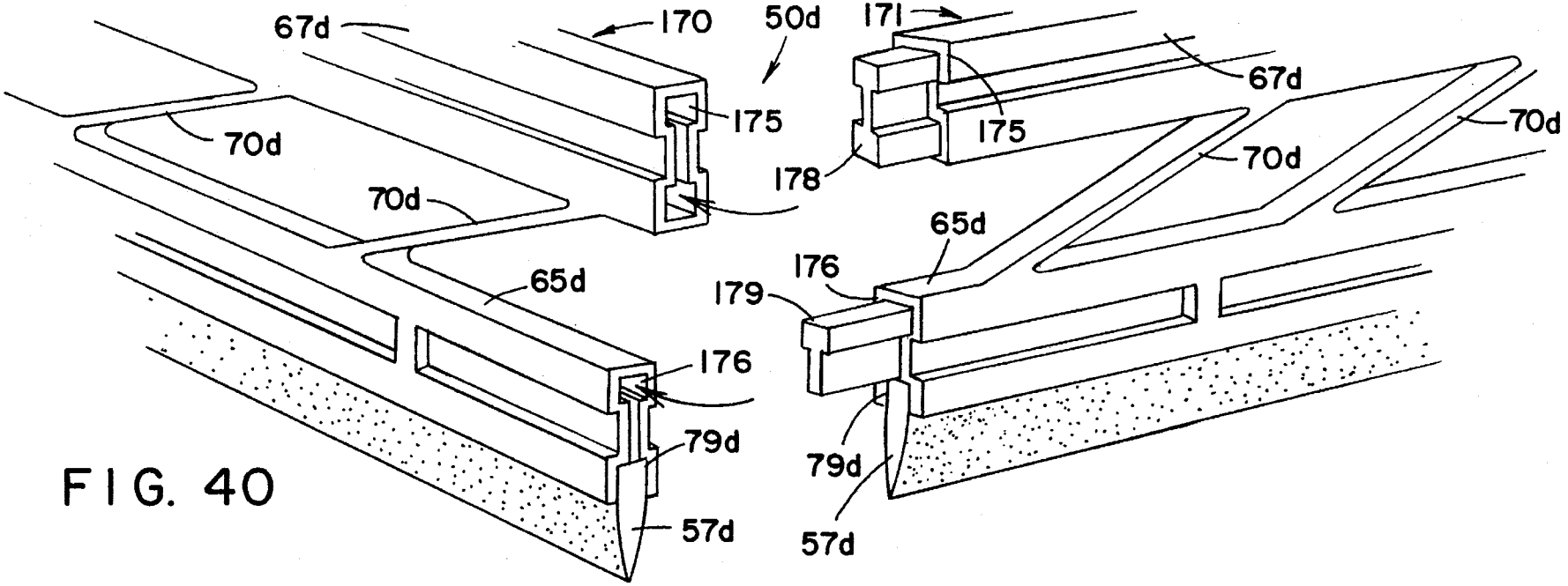
FIG. 40 is a front exploded perspective view of another embodiment of a modular sealing device (unmounted and without the cover) according to the invention showing a base sealing section and an extension sealing section separated from the base sealing section, which is especially suited for use with wide doors.

Referring to FIGS. 1–6, sealing device 50 according to the presently preferred embodiment of the invention is attached to the bottom of a door 55 and automatically causes a sealing element 57 thereof to contact and seal against a floor saddle 58 (or a bottom door sill or the floor 60) when door 55 is fully closed (FIGS. 1, 3 and 6), and to move out of contact with floor 60 as door 55 is opened (FIGS. 2 and 5). Sealing device 50 includes an elongated support element 65 which is attached to door 55, an elongated seal actuating element 67 movably supported from support element 65, the sealing element 57 attached to seal actuating element 67, and a plurality of spring elements 70 in the form of flexible strips coupled to movably and resiliently support seal actuating element 67 from support element 65. Sealing element 57 is attached to seal actuating element 67 so as to project from the bottom thereof, and is made of a flexible and/or resilient material so that when urged against saddle 58 (or floor 60 or carpeting (not shown)) in the sealing position of seal actuating element 67 shown in FIGS. 1 and 6, sealing element 57 complies with the saddle (or floor surface), even one that is not exactly flat and not exactly horizontal, and forms a positive seal against weather, dust, insects, etc. The bottom of seal actuating element 57 has a slot 79 (FIG. 4) therein into which a solid, ridged section of seal element 57 is inserted. Sealing element 57 includes the solid ridged section which is engaged within slot 79 and a hollow sealing section which projects from slot 79 and from seal actuating element 67. The shape for sealing element 57 shown in FIGS. 4–6 is exemplary. FIGS. 14 and 40 show other shapes for sealing elements 57*a* and 57*d* and slots 79*a* and 79*d*. Preferably, sealing elements 57, 57*a*, 57*d* are replaceable.

In the embodiment illustrated in FIGS. 1–6, spring elements 70 are connected at opposite ends thereof to support element 65 and seal actuating element 67. More specifically, spring elements 70 are integrally formed connected during manufacture to support element 65 and seal actuating element 67. For example, as presently preferred, spring elements 70 are homogeneously formed as one piece with support element 65 and seal actuating element 67. Other ways for coupling spring elements to the support element and the seal actuating element are described herein. Still other ways will be apparent to those of skill in the art.

Spring elements 70 constitute the sole support for seal actuating element 67 from support element 65 and act as a means for coupling the support and seal actuating elements, and are constructed and/or are coupled to support element 65 such that seal actuating element 67 may resiliently move towards and away from support element 65 while at the same time moving laterally with respect to support element 65, as indicated by the arrows in FIGS. 1–3. No other support or guiding structure need be provided for the embodiment of sealing device 50 depicted in FIGS. 1–2. FIGS. 1 and 6 show seal actuating element 67 in its projecting sealing position in which it is projected away from support element 65, and FIGS. 2 and 5 show seal actuating element 67 in its retracted non-sealing position in which it is closer to support element 65 than in its position in FIGS. 1 and 6 also laterally displaced to the left (as mounted to a left opening door) compared to its position in FIG. 1. The movement of seal actuating element 67 between the projecting sealing position of FIGS. 1 and 6 and the retracted non-sealing position of FIGS. 2 and 5 occurs automatically in response to the opening and closing of door 55 due to interaction between a projecting end 73 of seal actuating element 67 and a cam element 75 (the coupling means) projecting beyond the edge of door jamb 77 and molding 78. The embodiment of cam element 75 depicted in FIGS. 1, 2 and 7–10 is suitable for use with a door opening that is framed with moldings 78 or with a door opening without moldings. In either case, the end 76 of cam element 75 projects beyond door jamb 77 (FIGS. 7–9) on the hinge side of the door so that it is contacted at approximately an angle of 90° by projecting end 73 of sealing device 50 during initial opening and final closing of the door. In the embodiment depicted in FIGS. 1–2 and 7–10 cam element 75 has a curved or bevelled outer end 76 which guides projection 73 onto the remainder of cam element 75. Cam element 75 moves seal actuating element 67 laterally, and spring elements 70 in cooperation with projection 73 and cam element 75 move seal actuating element 67 vertically up and down as door 55 is opened and closed.

Cam element 75 (FIG. 9) essentially has only a one-direction camming surface which extends horizontally relative to door jamb 77 and molding 78 to cam projection 73 (FIG. 7) horizontally. The extent to which the end of cam element 75 projects is shown in FIGS. 7 and 8 in which the door hinges are represented in broken lines. The horizontal position of cam element 75 and the distance away from the opening at which it contacts projection 73 determine how long it takes to cam projection 73 to a sealing position of the device or to cam it towards the non-sealing position of the device (the "drop speed" of the device). The configuration of the cam element and the projecting end 73, and adjustment of the cam element will increase or decrease the tension on the spring elements and change the "drop speed". A high drop speed is preferred for applications in which the door moves over carpeting so that the sealing element may be moved quickly above the height of the carpet pile to clear the tops of the pile. Slower drop speeds are suitable for non-carpeted floors since the sealing element need only be moved slightly above the floor surface to clear the floor surface.

Cam element 75 has two holes 79 (FIG. 10) extending lengthwise in the central part of cam element 75, and is attached to door jamb 77 by screws 80. Holes 79 may be made slotted (not shown) to allow for adjustment of cam element 75 during installation and use to compensate for different doors, door jambs and moldings (if any), and for changes occurring during use due, for example, to wear, changes in the characteristics of the spring elements 70, creep of the sealing device if it is made of plastic, etc. In another embodiment of a cam element (cam element **75*a* depicted in FIGS. 11–12 and 24–27), the cam element has a two-direction camming surface (surface 120 in FIG. 25**) which cams the projection on the seal actuating element both laterally and vertically.

Referring to FIG. 1, sealing device 50 is mounted to door 55 such that (a) in the closed position of the door, seal actuating element 67 urges sealing element 57 against saddle 58 with sufficient force to effect a positive seal of sealing element 57 against saddle 58 with projecting end 73 of seal actuating element 67 bearing against cam element 75; and (b) in the partially opened position of door 55 shown in FIG. 2, sealing element 57 is spaced above and not in contact with saddle 58 and floor 60.

Spring elements 70 are structured to operate as follows. They are slender enough to function as leaf springs and robust enough to resiliently support sealing actuating element 67 from support element 65 and urge seal actuating element against floor 60 (through seal element 57) to make a positive seal with floor 60. Thus, spring elements 70 constitute the sole support for seal actuating element 67 and participate in moving seal actuating response element 67 in opening and closing the door. The angle at which spring elements 70 extend between support element 65 and seal actuating element 67 allows for the desired movement of seal actuating element 67 towards and away from support element 65 without over-stressing spring elements 70, while providing sufficient spring action to accommodate the desired movement of seal actuating element 67 while providing the good seal mentioned above. The degree of flexing required of spring elements 70 is illustrated in FIG. 3.

A cover 81 in the form of an elongated plate is attached to support element 65, but may be attached directly to door 55, or to both door 55 and support element 65. The cover 81 is preferably opaque, and is preferably paintable or supplied in different colors, or is in some way decorative. Cover 81 may function as a kick plate, and if so, is constructed accordingly, e.g., of crack-resistant plastic or of sheet metal such as aluminum or brass. Typically, the seal actuating element 67 will be smooth, as will cover 81, so that friction on seal actuating element 67 is not a problem. However, if desired or necessary, any suitable means may be used to reduce sliding friction on seal actuating element 67. For example, seal actuating element 67 may be made of a low friction material so as not to substantially impede movement thereof relative to cover element 67 and door 55. Cover 81 may also be made of a low friction material and cover 81 may be mounted so as to only lightly contact or be closely spaced from seal actuating element 67. Cover 81 may be attached to sealing device 50 without the use of fasteners by means, for example, of an interlocking slide fit as shown in FIGS. 4–6, or an interlocking snap fit as shown in FIGS. 17–19.

Referring to FIGS. 4–6, dove tailed shaped recesses 82 are provided on both sides of support element 65, and a mating dove tail shaped projection 83 is provided on the inside of cover 81. Cover 81 is attached to support element 65 by inserting the edge of projection 83 into the beginning of the recess 82 facing away from door 55 and sliding cover 81 onto support element 65. Cover 81 includes a top flange 84 which slides over and covers the top of support element 65. Since sealing device 50 may be reversed from the position shown in FIGS. 5 and 6 when attached to a right-opening door (as discussed below), a dove tail shaped recess 82 is provided on both sides of support element 65. Other structures for slid-fitting cover 81 to support element 65 will be apparent to those of skill in the art. Alternatively, cover element 81 may be attached to door 55 by means of screws passing through aligned holes (not shown) in cover 81 and support element 65.

Sealing device 50 and cover 81 are preferably made entirely of any suitable plastic material or materials. The particular plastic material for spring elements 70 is selected in consideration of the spring action required of spring elements 70, proper operation of sealing device 50 over a wide temperature range, e.g., about 0° F. to about 180° F. and the ability of spring elements 70 to satisfactorily operate over hundreds of thousands of door openings and closings. That allows sealing device 50 to be attached to the outside of a door in most geographic locations, if desired. The presently preferred material for spring elements 70, as well as for support element 65 and seal actuating element 67 is copolymer polypropylene and polyester. Other suitable materials are polyethylene, polystyrene and polyvinyl chloride. Fiber glass, carbon, aramid or other materials may be added to increase strength and/or performance. Preferably, a flame retardant polymer is used, and device 50 and cover 81 are made from recycled plastics. Support element 65, seal actuating element 67 and spring elements 70 are preferably molded at the same time from the same material as a unitary, homogeneous, integral piece, although support element 65 and seal actuating element 67 may be molded separately, and then spring elements 70 molded thereto, or heat welded thereto, etc. Device 50 and cover 81 may be injection molded, or molded by any suitable process, or die cut from pre-formed plastic sheets.

To improve the life and performance of spring elements 70 where they are made of plastic material, the molecular structure of the plastic may be oriented in any suitable manner. While plastic is the preferred material for spring elements 70, they may be made of a spring metal and connected as described herein. Seal element 57 may be made of any suitable resilient and preferably flexible material such as elastomers, e.g., neoprene and natural rubber, and foamed plastics.

Sealing device 50 may be attached to door 55 by means of screws 86 (FIG. 3) passing through holes 87 in tabs 88 depending from support element 65. Tabs 88 are configured (e.g., extend the full width of sealing device 50) so that sealing device 50 may be attached with either side facing door 55 for left-opening and right-opening doors as described below. Also, holes 87 in tabs 88 are countersunk at both ends (FIG. 5) for the same reason and so that the screws do not protrude from a side of the sealing device, which might otherwise hinder attachment of cover 81. When support element 50 is made of plastic, tabs 88 are preferably formed integrally with support element 50.

In order to ensure that the sealing element 57 makes positive contact with saddle 58 (or floor 60), sealing device 50 is installed on door 55 with a predetermined spacing between support element 65 and seal actuating element 67. Support element 65 is positioned relative to saddle 58 such that the seal actuating element 67 urges the seal element 57 into contact with the saddle 58, and the projecting end 73 of seal actuating element 67 is in contact with the cam element 75 at approximately a 90° angle in the closed position of the door. The proper position of sealing device 50 to accomplish the foregoing places spring elements 70 in a stressed condition with door 55 closed, as shown in FIGS. 1, 3 and 6 (broken lines).

Referring to FIG. 3, a spacer element 90 attached to support element 65, and stops 91, 92 projecting from seal actuating element 67 are provided to pre-position seal actuating element 67 relative to support element 65 during installation of sealing device 50. Spacer element 90 is attached to support element 65 by a living hinge 93 so that the spacer element 90 may pivot relative to support element 65.

Installation may proceed as follows. First, sealing device 50 is placed against door 55 with the door closed, with projection 73 contacting cam element 75 so as to laterally move seal actuating element 67 into alignment with support element as shown in FIG. 3, and with sealing element 57 in contact with saddle 58. Then, support element 65 is pushed upwardly and spacer element 90 is pivoted into engagement with a stop 90 to separate seal actuating element 67 from support element 65 by almost the length of the spacer element 90. Another stop 92 is provided so that seal actuating element 67 may be spaced a little further from support element 65 when spacer element 90 engages stop 92. This provides some adjustability in fixing the distance of sealing element 67 from support element 65 during installation. Support element 65 may now be attached to door 55 simply by threading screws 86 into door 55 through holes 87 in support element 65 while sealing element 67 simply rests on saddle 58. Alternatively, sealing device 50 may be placed on a flat surface, the support element 65 and the sealing element 67 aligned and spaced so that spacer elements 90 may be pivoted into engagement with a stop 91 or 92. Then, sealing device 50 may then be placed against door 55 with projection 73 in contact with cam element 73, and screwed to door 55.

To further facilitate installation of sealing device 50, the holes in door 55 for screws 86 may be pre-drilled using support element 65 as a template. Referring to FIG. 3, with sealing device 50 positioned against door 55 as described above, the locations for screws 86 are marked; then, sealing device 50 is moved away from door 55 and the holes for screws 86 are pre-drilled.

Figure 15:
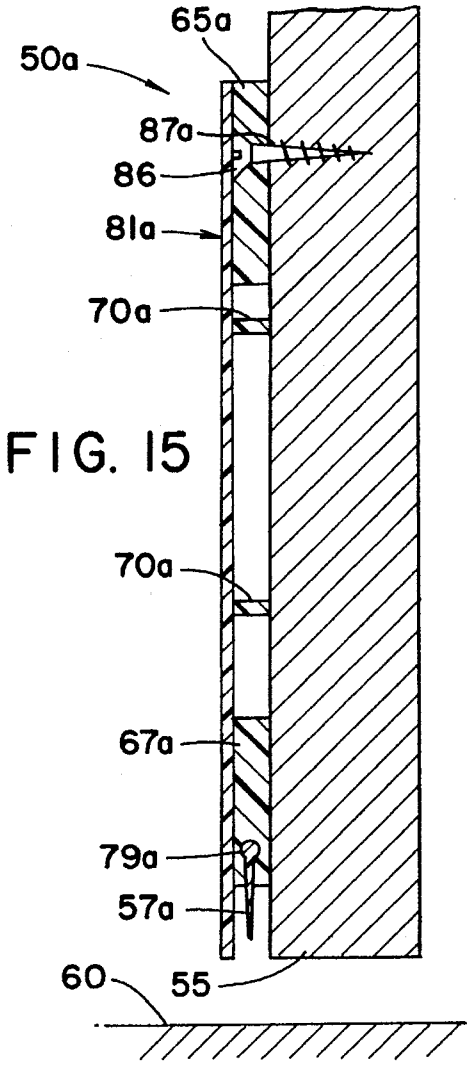
FIG. 15 is a vertical section view of the sealing device and door of FIG. 11 taken with the door open.
Figure 13:
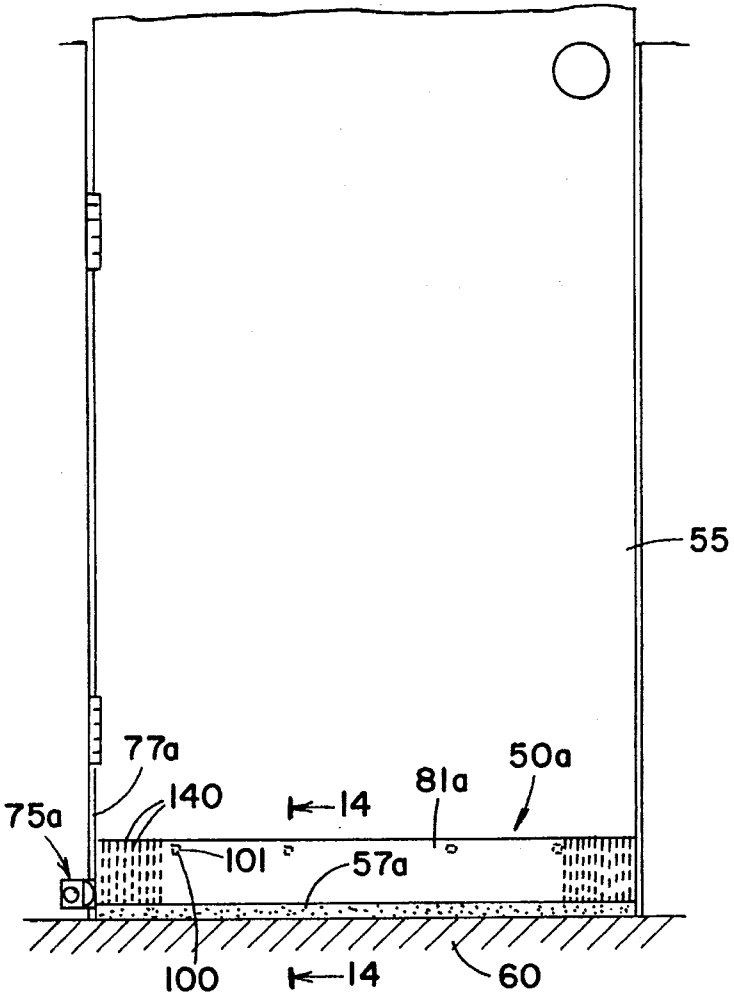
FIG. 13 is a front elevational view of the sealing device of FIG. 11 mounted to the bottom of the door with the door closed and the sealing element in its projecting sealing position contacting the floor.

FIGS. 11–27 depict another embodiment of a sealing device **50*a*, another embodiment of a cam element 75*a* and another embodiment of a cover 81*a* according to the invention. Sealing device 50*a* includes a support element 65*a* which is similar to support element 65, a seal actuating element 67*a* which is similar to seal actuating element 67 and spring elements 70*a* which are similar to spring elements 70. Sealing device 50*a* is constructed and operates generally as described above for sealing device 50, and seal actuating element 67*a* moves in the directions of the arrows in FIGS. 11 and 12. Among the differences between sealing device 50 and sealing device 50*a* are the following. The cover 81*a* is mounted to support element 65*a* by an interlocking snap fit (FIGS. 17–19) rather than an interlocking slide fit, as described below; cam element 75*a* (FIGS. 24—27) doubly cams seal actuating element 67*a* horizontally and vertically, as described below; the seal actuating element 67*a* of sealing device 50 may be prepositioned relative to the support element 65*a* by removable spacer elements 90*a* (FIGS. 20–23), as described below; sealing element 57*a* is shaped differently from sealing element 57; and sealing device 50*a* has a somewhat different profile shape than sealing device 50. Also, sealing device 50*a* seals against the floor 60 rather than a saddle 58, and is used with a door opening not framed by moldings. FIGS. 11, 13 and 14 show the sealing device 50*a* in the closed position of the door, and FIGS. 12 and 15 show the sealing device 50*a*** in the open position of the door.

Referring to FIGS. 17–19, cover **81*a* is snap-fitted to support element 65*a* by means of protrusions 100 projecting from the inside of cover 81*a* and holes 101 in support element 65*a*. Holes 101 have larger diameter ends 104 and a smaller diameter central portion 105, and protrusions 100 have a larger diameter end 106 and a smaller diameter shaft 107. Ends 106 of protrusions 100 are slightly larger than central portion 105 of holes 101 and are slightly smaller than ends 104 of holes 101. Protrusions 100 are made of a resilient material so that ends 106 may pass through the smaller diameter portions 105 of holes 101 and be snap-fitted thereto. Cover 81*a* may be removed simply by pulling it back away from support element 65*a* to overcome the force of the snap-fit. Other structures for snap-fitting cover 81*a* to support element 65*a* will be apparent to those of skill in the art. Alternatively, cover element 81*a* may be attached to door 55 by means of screws passing through aligned holes (as shown in FIGS. 49 and 50) in cover 81*a* and support element 65*a*. Sealing device 50*a* and cover 81*a* are made of materials as described above for sealing device 50**.

Sealing device **50*a* may be installed on a door 55 as follows. In the closed position of door 55**, support element 65*a* is attached to the bottom of door 55 by screws 86. However, support element 65*a* is positioned relative to floor 60 such that seal actuating element 67*a* urges seal element 57*a* into contact with floor 60 and projecting end 73*a* of seal actuating element 67*a* is in contact with cam element 75*a*. The proper position of sealing device 50*a* to accomplish the foregoing places spring elements 70*a* in a stressed condition with door 55 closed, as shown in FIGS. 16 (broken lines) and 18.

Figures 20, 21, 22, 23:
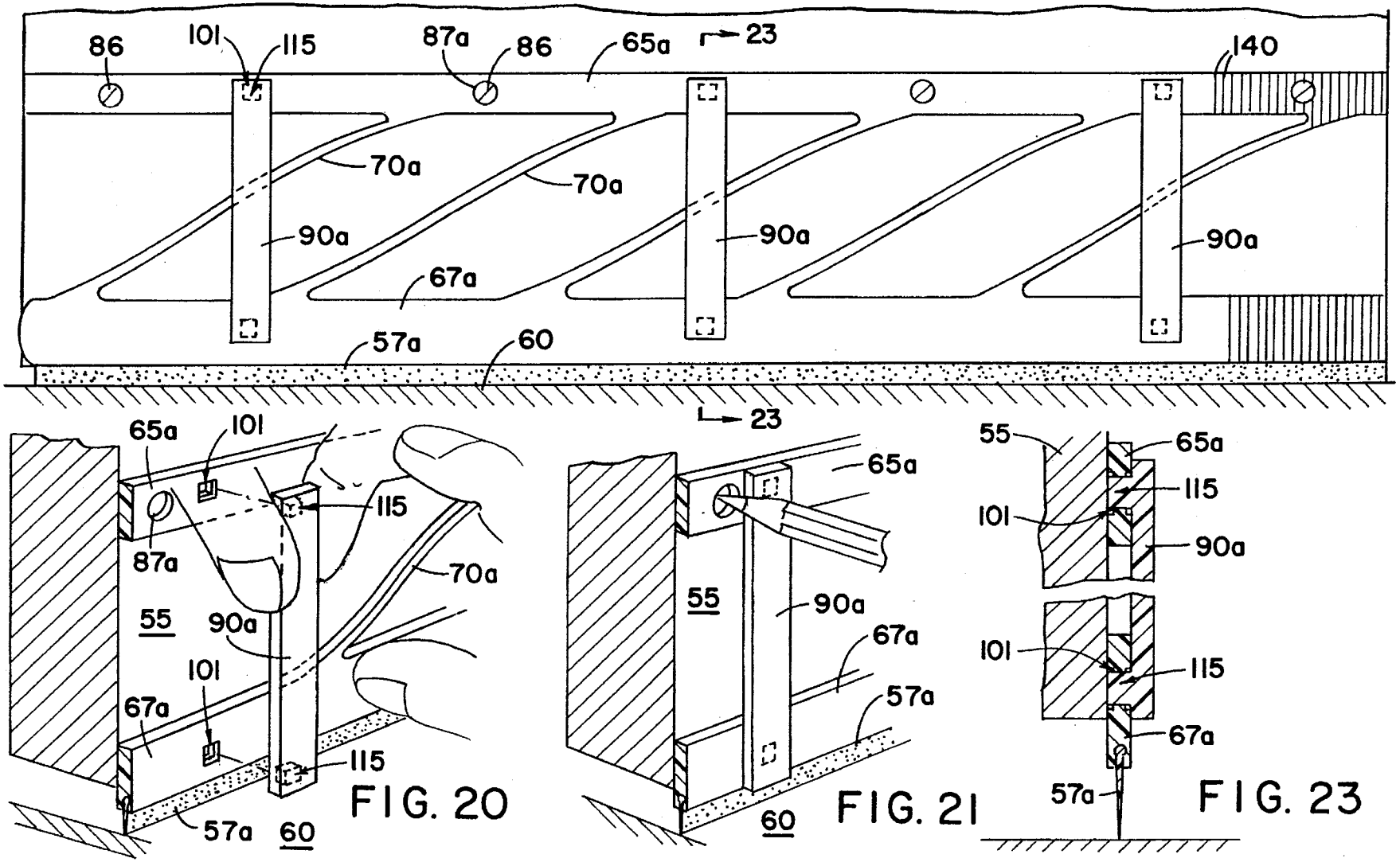
FIGS. 20 and 21 are front perspective views of a part of the sealing device of FIG. 11 illustrating use of spacers which maintain the device in a predetermined configuration during installation of the device.
FIG. 22 is a front elevation view of the sealing device and door of FIG. 11, with the cover removed and the spacers of FIGS. 20 and 21 inserted into the device.
FIG. 23 is a section view of the sealing device and door of FIG. 11 without the cover and including the spacers of FIG. 20 taken along line 23—23 in FIG. 22.
Figures 31, 32:
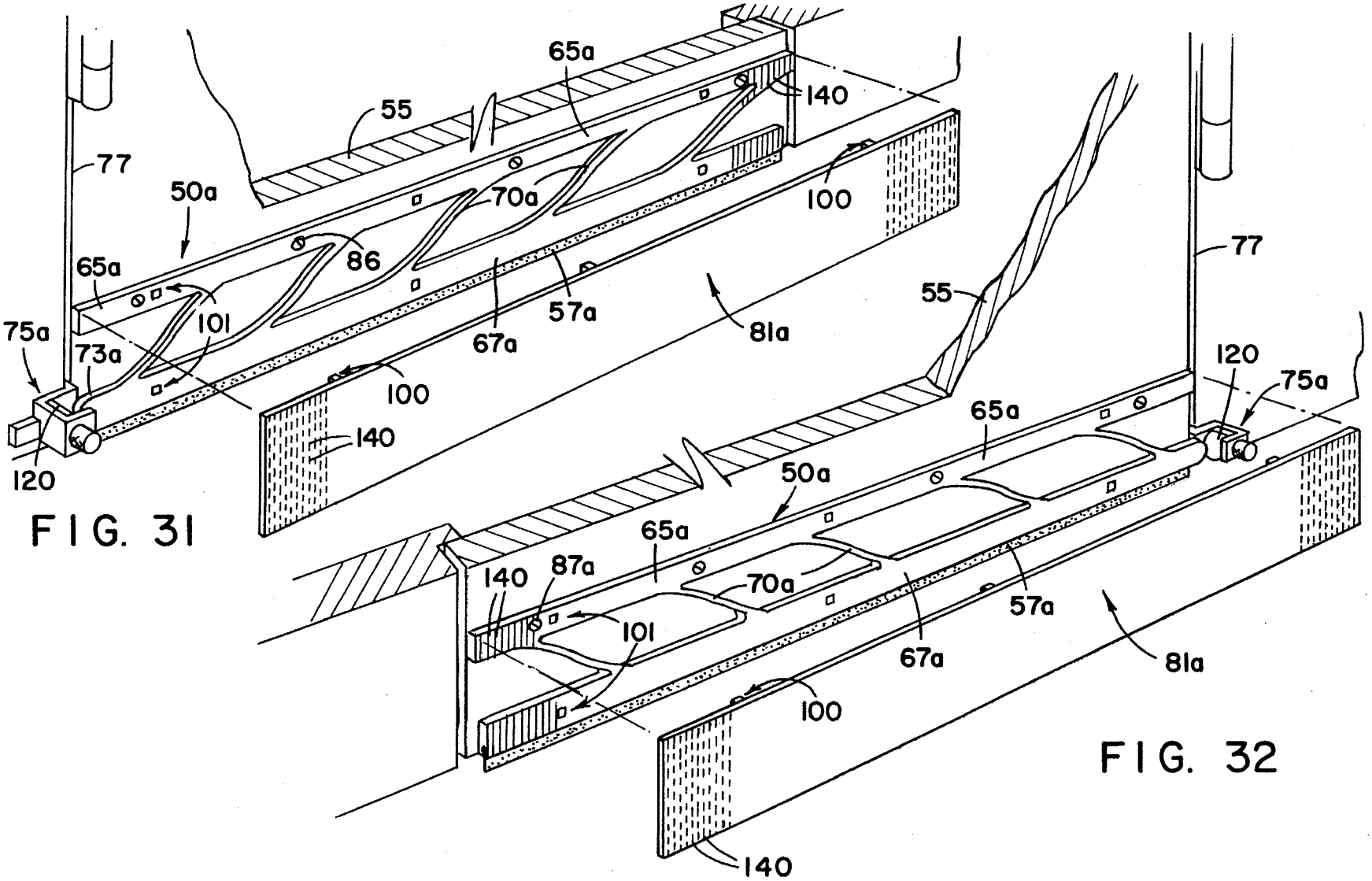
FIG. 31 is front exploded perspective view of the sealing device of FIG. 11 mounted to a left-opening door, in which the cover is separated from the sealing device.
FIG. 32 is a front exploded perspective view similar to that of FIG. 31 but showing the same sealing device as in FIGS. 11 and 31 but mounted to a right opening-door.

Referring to FIGS. 20–23, spacer elements 90*a* and holes 112 in support element 65*a* and seal actuating element 67*a* are provided to pre-position sealing element 67*a* and support element 65*a* during installation of sealing device 50*a*. First, sealing device 50*a* is placed against door 55 with the door closed, with projection 73*a* contacting cam element 75*a* so as to laterally move seal actuating element 67*a* into alignment with support element 65*a* as shown in FIG. 22, and with sealing element 57 in contact with floor 60. (That initial placement of sealing device 50*a* without spacer elements 90*a* is not shown.) Then, as shown in FIG. 20, support element 65*a* is pushed upwardly until hole 101 in support element 65*a* and seal actuating element 67*a* are separated by a distance equal to the spacing between prongs 115 of elements 90*a*, and spacer elements 90*a* are secured to sealing device 50*a* by pressing them against support element 65*a* and seal actuating element 67*a* so that prongs 115 enter holes 101. Support element 65*a* may now be attached to door 55 simply by threading screws 86 into door 55 through holes 87*a* in support element 65*a* while sealing element 67*a* simply rests on floor 60. Alternatively, sealing device 50*a* may be placed on a flat surface, the support element 65*a* and the sealing element 67*a* aligned and spaced so that the spacer element 90*a* may be pressed into holes 112. Sealing device 50 may then be placed against door 55 with projection 73*a* in contact with cam element 75*a*, and screwed to door 55. To further facilitate installation of sealing device 50*a*, the holes in door 55 for screws 86 may be pre-drilled, as described above using support element 65*a* as a template. After attaching support element 65*a* to door 55 with screws 86, cam element 75*a* may be adjusted to finally adjust sealing device 50*a*.

Referring to FIGS. 11–13 and 24–27, cam element 75*a* includes a two-direction or double-acting camming surface 120 against which projecting end 73*a* of seal actuating element 67*a* bears as door 55 opens and closes. The camming surface 120 of cam element 75*a* is curved in the vertical and horizontal directions (FIGS. 25–27), and the projecting end 73*a* of seal actuating element 67*a* is curved in the vertical direction so that when door 55 is opened, the camming surface 120 not only allows seal actuating element 67*a* to move laterally to the right, but also cooperates with projecting end 73*a* to doubly cam projecting end 73*a* upwardly as seal actuating element 67*a* rises and moves laterally through the action of spring elements 70*a*. The slopes of the camming surface 120 are selected to provide for movement of the seal actuating element 67*a* over a predetermined vertical distance for a given lateral movement thereof. That predetermined vertical distance corresponds to the distance from the bottom of seal element 67*a* and floor 60 in the open position of the door. FIGS. 26 and 27 illustrate the two positions of the seal element 67*a* in the closed and open positions, respectively, of the door. The camming surface 120 is adjustably mounted to a bracket 124 which is attached to door jamb 77*a*.

Referring to FIGS. 24–27, bracket 124 comprises a channel made up of opposed sides 125, 126 and a central web 127, and a flange 128 extending at a right angle to side 125 of the bracket. Flange 128 has slotted holes 129 in it by means of which bracket 124 is adjustably attached to door jamb 77*a* by screws 130 (FIG. 25). Attached to the side of camming surface 120 facing the web 127 of bracket 124 are a guide 132 and a threaded shaft 133. The guide 132 is in the form of a bar or strip which extends from camming surface 120 through a slot 134 in web 127 having the same shape as guide 132 but slightly larger so as to permit sliding movement of guide 132 in slot 134. Threaded shaft 133 extends from camming surface 120 through a hole 135 in web 127. Threaded onto shaft 133 is an internally threaded nut 136 also having on the exterior thereof a worm gear. Rotation of nut 136 on shaft 133 causes shaft 133 to move camming surface 120 relative to bracket 124. A thumbscrew 137 having a knurled knob 138 at one end projecting from side 126 of bracket 124 and a worm gear 139 thereon within bracket 124 is rotatably supported near knob 138 in a hole 140 in side 126 of bracket 124 and at a free end thereof in a hole 141 in a support bracket 142 attached to web 127. The worm gear 139 carried by thumbscrew 137 is in mesh with the nut 136 so that rotation of thumbscrew 137 rotates nut 136. Camming surface 120 is advanced out of bracket 124 and retracted into bracket 124 by rotating thumbscrew 137. After sealing device 50*a* has been mounted to door 55, the location of camming surface 120 is adjusted for the desired movement of seal actuating element 67*a*. Further adjustments may be made during use to compensate for wear, creep, etc., as discussed above.

Sealing devices 50 and 50*a* may be provided in a number of sizes to fit standard doors. Alternatively, or additionally, sealing devices 50 and 50*a* may be provided in one or a limited number of sizes to fit a number of door sizes. Referring to FIG. 2, sealing device 50 at the end thereof opposite to projecting end 73 has a number of pre-weakened portions 140 extending through support element 65, seal actuating element 67 and at least one spring element 70. Similarly, referring to FIG. 12, sealing device 50*a* at the end thereof opposite to projecting end 73*a* has a number of pre-weakened portions 140 extending through support element 65*a*, seal actuating element 67*a* and at least one spring element 70*a*. The following description for adjusting the length of sealing device 50*a* applies as well to sealing device 50.

Referring to FIGS. 28–30, sealing device 50*a* may be cut or snapped along a pre-weakened portion 140 to adjust the length of sealing device 50*a* for the particular door to which it is to be attached. Pre-weakened portions 140 are not provided on the end of sealing device 50*a* with projecting end 73*a* since projecting end 73*a* must be retained to contact the cam element 75*a*. Pre-weakened portions 140 are simply reduced thickness portions extending along lines, but may be pre-weakened along lines in other ways, e.g., by heat, material composition, etc. The pre-weakened lines are situated on the door side of sealing device 50*a* so as not to be visible when sealing device 50*a* is mounted to a door. After the desired length of sealing device 50*a* has been determined, one cuts along a weakened line portion 140 using, for example, a utility tool, and/or simply snaps along a pre-weakening line portion 140 to sever the unwanted end of sealing device 50*a*. Thus, no special tools like a hack saw are required to shorten sealing device 50*a*. Before cutting along a pre-weakened line portion 140, the ends of support element 65*a* and seal actuating element 67*a* are aligned (FIG. 28) by moving the seal actuating element 67*a* laterally. After severing the end of sealing device 50*a* and releasing seal actuating element 67*a*, seal actuating element 67*a* will move laterally to the left (FIG. 30) offset from support element 65*a*. Cover element 81*a* has similar weakened portions 140 on the inside thereof which are cut and/or snapped in a similar manner.

The same sealing devices 50 and 50*a* and cover elements 81 and 81*a*, respectively, may be used for a left-opening door and a right opening door simply by reversing sealing devices 50 or 50*a* end-to-end and positioning cam elements 75 or 75*a* on the hinge side of the door jamb. Covers 81 and 81*a* are not end-to-end reversed for right and left opening doors, and include weakened portions 140 on the inside thereof at both ends. The weakened portions 140 at the right end of cover 81 and 81*a* are cut or snapped for a left opening door, and the weakened portions 140 at the left end of 81 and 81*a* cover are cut or snapped for a right opening door. With respect to mounting cover 81 to sealing device 50 for installation of sealing device 50 on a left-opening or a right-opening door, support element 65 has dove tail recesses 82 on both sides thereof for receiving the dove tail projection 83 on cover 81. Thus, reversing sealing device 50 for left-opening or right-opening doors presents no problems when sealing device 50 is shortened. With respect to sealing device 50*a* and cover 81*a*, the locations of the holes 101 in support element 65*a* and the protrusions 100 in cover 81*a* are symmetrically located relative to the centers of support element 65*a* and cover 81*a* so that regardless of which end of cover 81*a* is cut, the holes 101 and protrusions 100 will be aligned.

The invention therefore provides sealing devices 50 and 50*a* and covers 81, 81*a* which may be used on left or right opening doors of various sizes. The drawings illustrate attachment of sealing devices 50, 50*a* to the inside of a door. However, a sealing device 50, 50*a* may also be attached to the outside of a door. In that case, the cam element is moved to project from the outside of the door jamb on the hinge side of the door. Alternatively, the cam element may be positioned on the side of the door jamb opposite the hinges for embodiments in which the sealing device is attached to the inside and the outside of the door.

As mentioned above, a sealing device 50, 50*a* may be installed on a door which closes an opening that is framed with moldings, or which does not have moldings. However, installation of cam element 75*a* with an opening framed with moldings may require that part of the molding be cut away.

Figure 36:
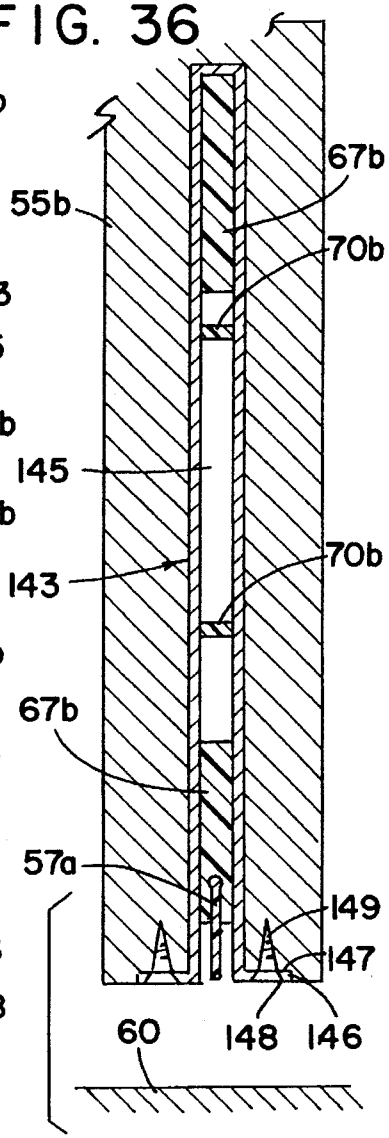
FIG. 36 is a section view of the sealing device and door of FIG. 33 taken along line 36—36 in FIG. 34.
Figure 35:
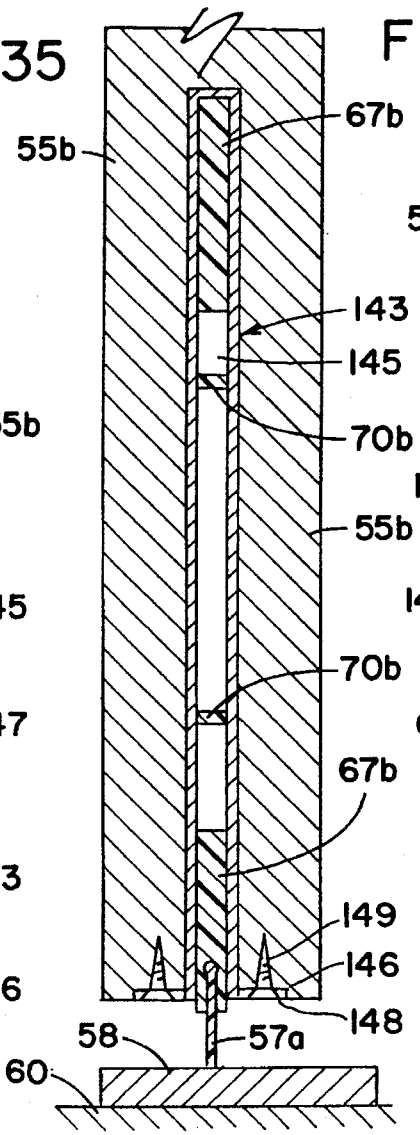
FIG. 35 is a section view of the sealing device and door of FIG. 33 taken along line 35—35 in FIG. 33.
Figure 37:
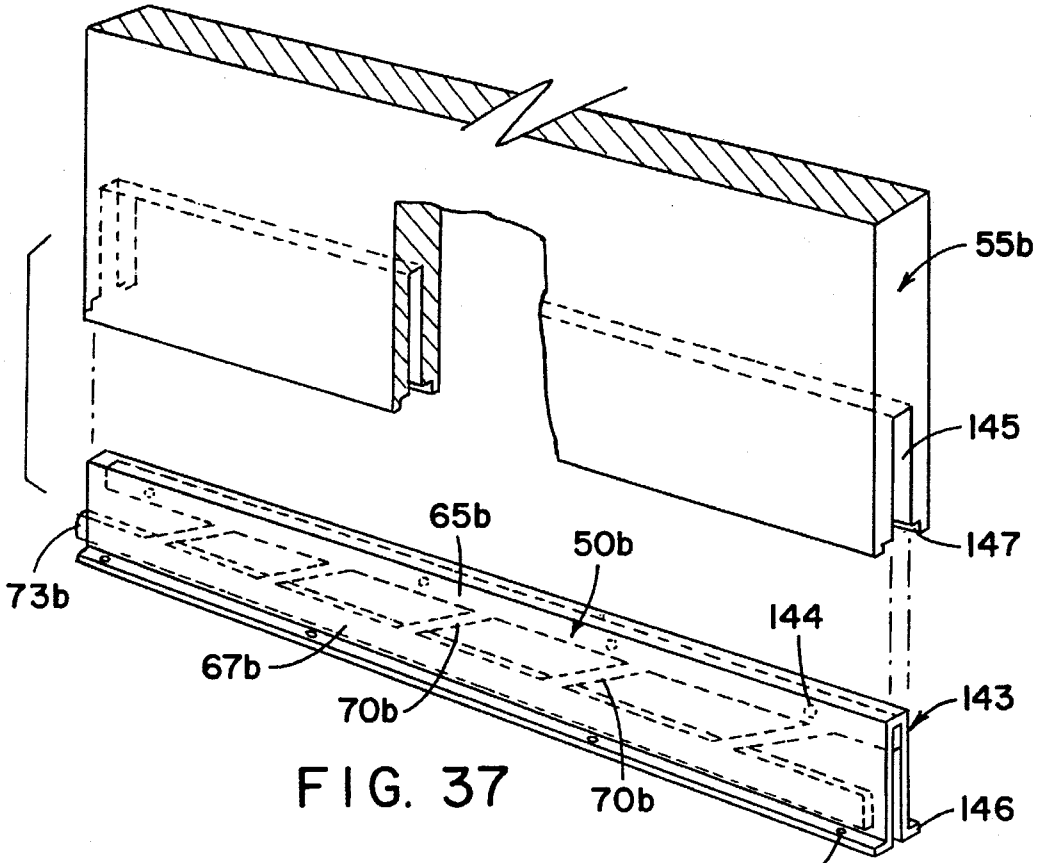
FIG. 37 is an exploded perspective view of the sealing device and door of FIG. 33 with the door partially broken away and the sealing device separated from the door.

An in-the-door mounted or mortise-mounted sealing device 50*b* is illustrated in FIGS. 33–37. Sealing device 50*b* is mounted in a channel 143 by means of screws (not shown) passing through holes 144 on one side of channel 143, holes (not shown) in support element 65*b* and threaded holes (not shown) in the other side of channel 143. Door 55*b* has a slot 145 in the bottom thereof in which is mounted channel 143. Sealing device 50*b* is first mounted in channel 143, then channel 143 is mounted in door slot 145. Channel 143 has out-turned edges 146, and the bottom edge of door 55*b* has recesses 147 to receive channel edges 146 therein (FIGS. 35–37). Channel edges 146 have holes 148 therein through which screws 149 are passed to secure channel 143 (with sealing device 50*b* therein) within slot 145 of door 55*b*. Sealing device 50*b* is mounted within channel 143 so that seal actuating element 67*b* may move freely therein, as generally described above with respect to seal actuating element 67, cover 80 and door 55. Cam element 75*b* (FIGS. 33–34) is mounted to the inside edge of door jamb 77. Holes in channel 143 and sealing device 50*b* and the depth of channel 143 are pre-selected, so that when channel 143 is mounted in slot 145 of door 55*b*, sealing element 57*b* will contact saddle 58 with the desired force in the closed position of door 55*b*, and sealing element 57*b* will be above and out of contact saddle 58 and with floor 60 in the opened positions of the door as described for sealing device 50. Mortise-mounted sealing device 50*b* has application not only to OEM, but also to after market where handy or skilled persons can install it in an existing door installation.

Figure 38:
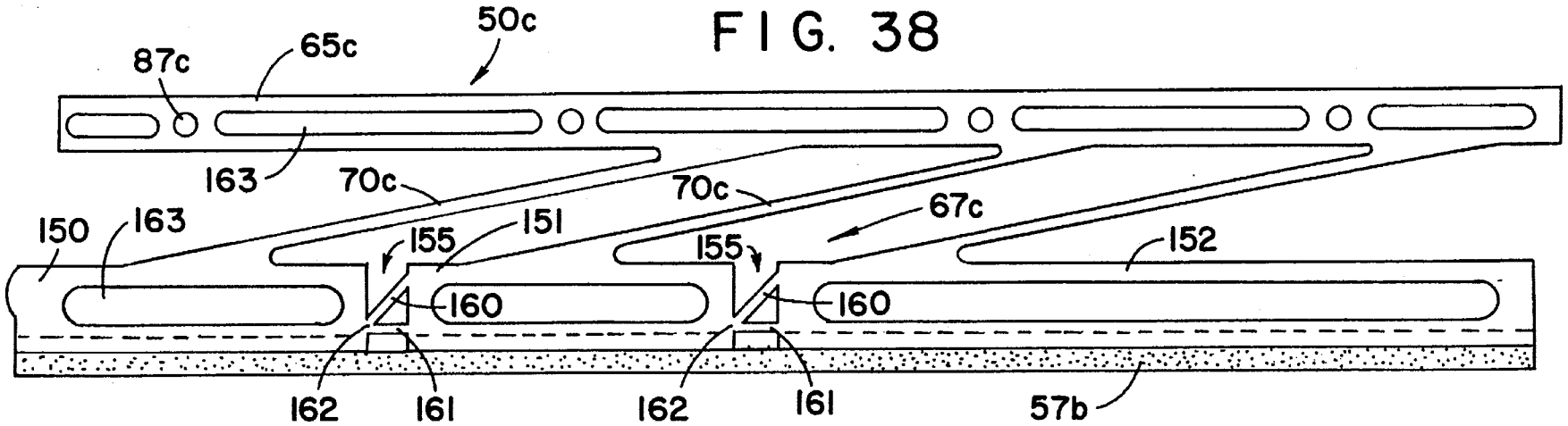
FIG. 38 is a front elevation view of another embodiment of a sealing device (unmounted and without the cover) according to the invention which is especially suited for use with uneven floor surfaces.
Figure 39:
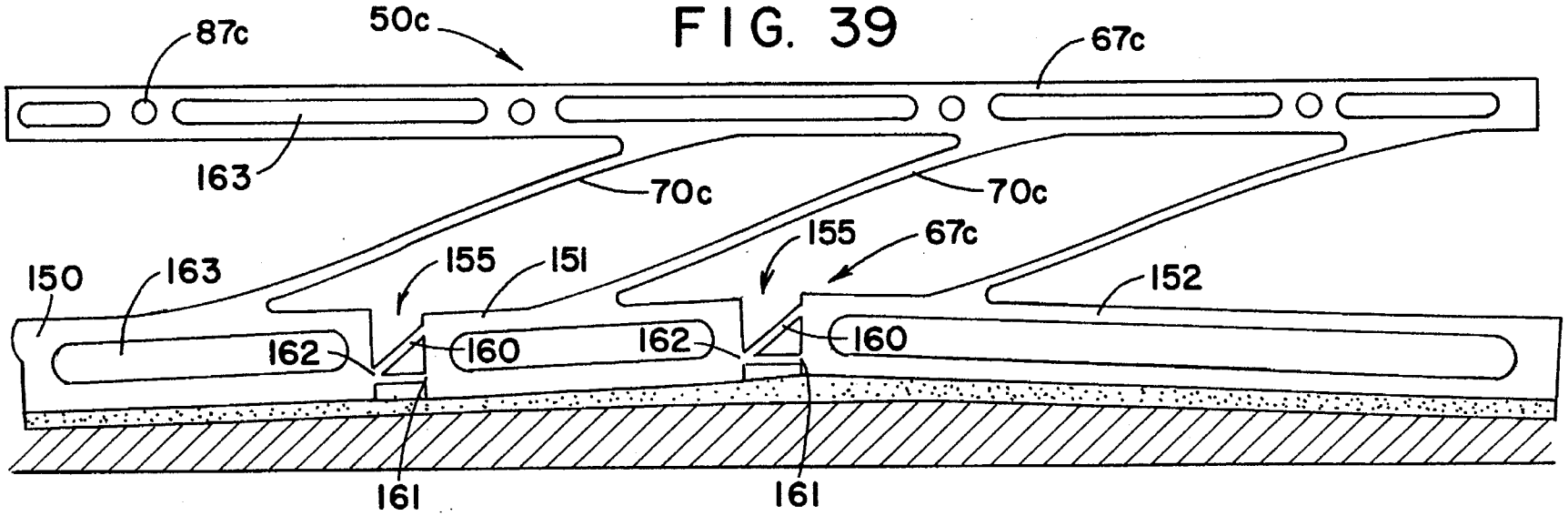
FIG. 39 is a front elevation view of the sealing device of FIG. 38 illustrating sealing of an uneven floor surface.

FIGS. 38 and 39 illustrate an embodiment of a sealing device which can accommodate a larger variation in the surface of a floor below the door to which the device is mounted. Sealing device 50*c* includes a seal actuating element 67*c* comprised of a plurality of articulated sections 150, 151 and 152 which may bend or pivot relative to each other at the joints 155 of the sections. Sealing device 50*c* may seal against a generally flat floor surface or an uneven floor surface as shown in FIG. 39. The joints 155 linking sections 150 and 151 and sections 151 and 152 each comprise two links 160, 161 connected at opposite ends to adjacent sections 150, 151, and 151, 152. Links 160 and 161 are flexible and/or their connection to sections 150, 151 and 152 are flexible so that adjacent sections 150, 151 and 151, 152 may bend or pivot relative to each other as shown in FIG. 39. Links 160 and 161 are connected generally spaced apart to one section and connected either close together (not shown) or at a vertex 162 to the adjacent section to promote bending where the links are connected close to each other or at the vertex 162. At least one spring element 70*c* connects each section 150, 151, 152 to support element 65*c*. The lengths of sections 150, 151 and 152 may be different, and longer sections (not shown) may be connected by two or more spring elements 70*c* to support element 65*b*. While a sealing device 50*c* with three sections 150, 151, 152 is illustrated, a sealing device may have only two, or more than three such sections. Sealing device 50*c* illustrated in FIGS. 38 and 39 includes open areas or holes 163 which reduce the material content of sealing device 50*c* without effectively weakening it, thereby reducing costs.

Figure 41:
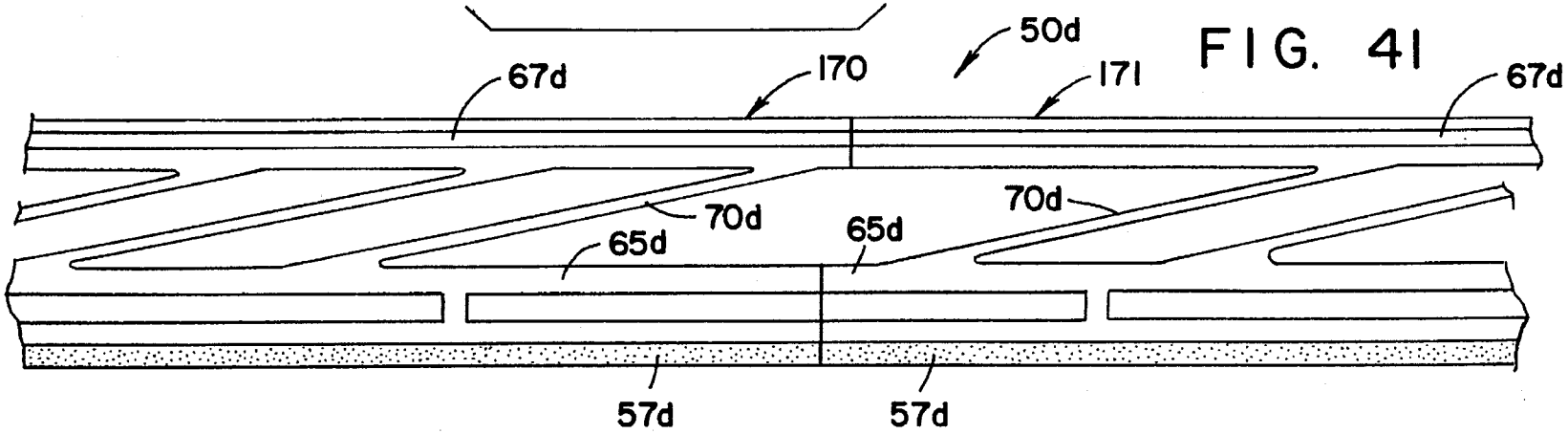
FIG. 41 is a front elevation view of the sealing device of FIG. 40 shown with the base and extension sections joined.

In the embodiment depicted in FIGS. 1, 2, 11, 12 and 28–30, the length of sealing devices 50, 50*a* may be reduced without the use of special tools to fit a range of door sizes. In the embodiment of sealing device 50*d* depicted in FIGS. 40 and 41, the length of sealing device 50*d* may be extended to fit wide doors such as garage doors or doors in industrial facilities. Sealing device 50*d* (FIGS. 40–41) is of modular design and comprises a base sealing device 170 having a projecting end (not shown) similar or identical to projecting end 73, 73*a* of sealing devices 50 and 50*a* and one or more extension sections 171. The right ends of support element 65*d* and seal actuating element 67*d* of base sealing device 170, and both ends of support element 65*d* and seal actuating element 67*d* of extension section 171 include hollow ends 175, 176 of a given cross-sectional configuration. The cross-sectional configurations of the ends 175 of support elements 65*d* are the same, and the cross-sectional configurations of the ends 176 of sealing actuating element 67*d* are the same. A shaped peg 178 is inserted into the hollow ends 175 of support elements 65*d* of base sealing 170 and extension section 171, and a shaped peg 179 is inserted into the hollow ends 176 of seal actuating element 67*d* of base sealing device 170 and extension section 171 to join the base sealing device and the extension section 170, 171 together as shown in FIG. 41. The cross-sectional configuration of shaped pegs 178 and of hollow ends 175 are similar, and the cross-sectional configurations of shaped pegs 179 and of hollow ends 176 are similar. Shaped pegs 178, 179 and the hollow ends 175, 176 may have configurations other than those depicted in the drawings. A cover may be provided for each base sealing device or extension section which abut when they are attached to the sealing device and extension section as described above.

In the extension embodiment illustrated in FIGS. 40 and 41, shaped pegs 179 are provided which are inserted into both the base sealing device 170 and the extension section 171. In other embodiments, the shaped pegs may be fixed to the ends of the extension section 171 or the ends themselves of the extension section 171 may be shaped to telescope into the hollow ends of the base sealing device 170. In still another embodiment, the base sealing device 170 and the extension section 171 may be made identical, and both provided with a projecting end which is shaped so as to fit into the hollow end of the seal actuating element of an adjacent sealing device and which functions as a projecting end to be cammed by a cam element. In that embodiment, a first base sealing device may be mounted with the shaped projecting end on the seal actuating element in contact with the cam element and a second base sealing device attached as an extension section with the shaped projecting end on the sealing actuating element inserted into the hollow end of the seal actuating element of the first base sealing device. A shaped peg may be inserted into the hollow ends of the support elements of the first and second base sealing devices to connect them.

Figure 42:
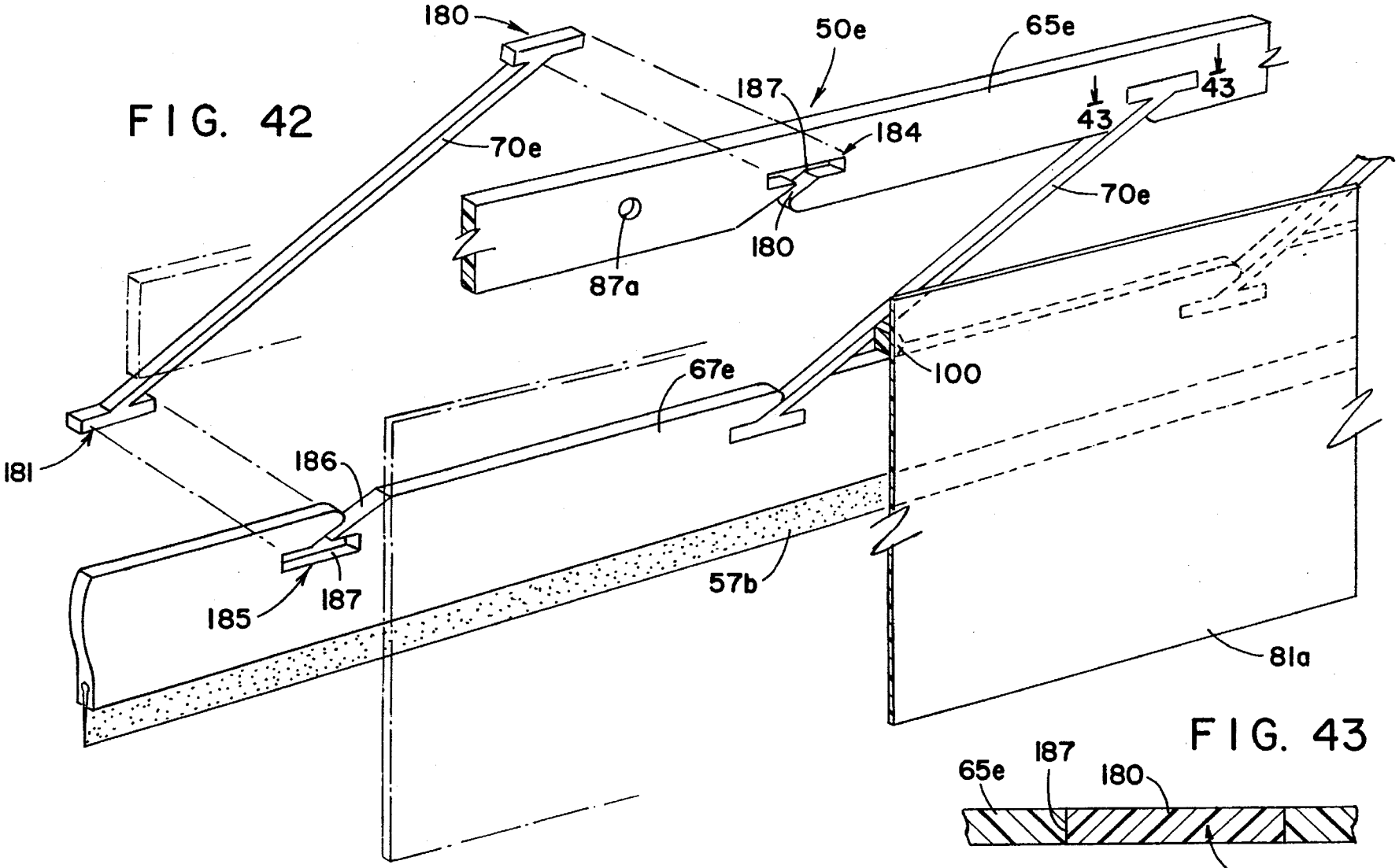
FIG. 42 is an exploded perspective view of a sealing device according to another embodiment of the invention having snap-in spring elements, depicting a spring element separated from the remainder of the device with the cover broken away.
Figure 43:
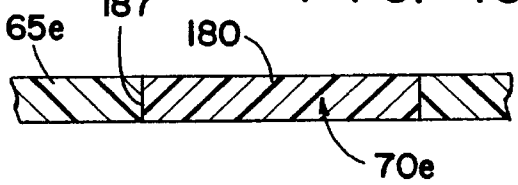
FIG. 43 is a section view of the sealing device of FIG. 42 taken along line 43—43 in FIG. 42.
Figure 45:
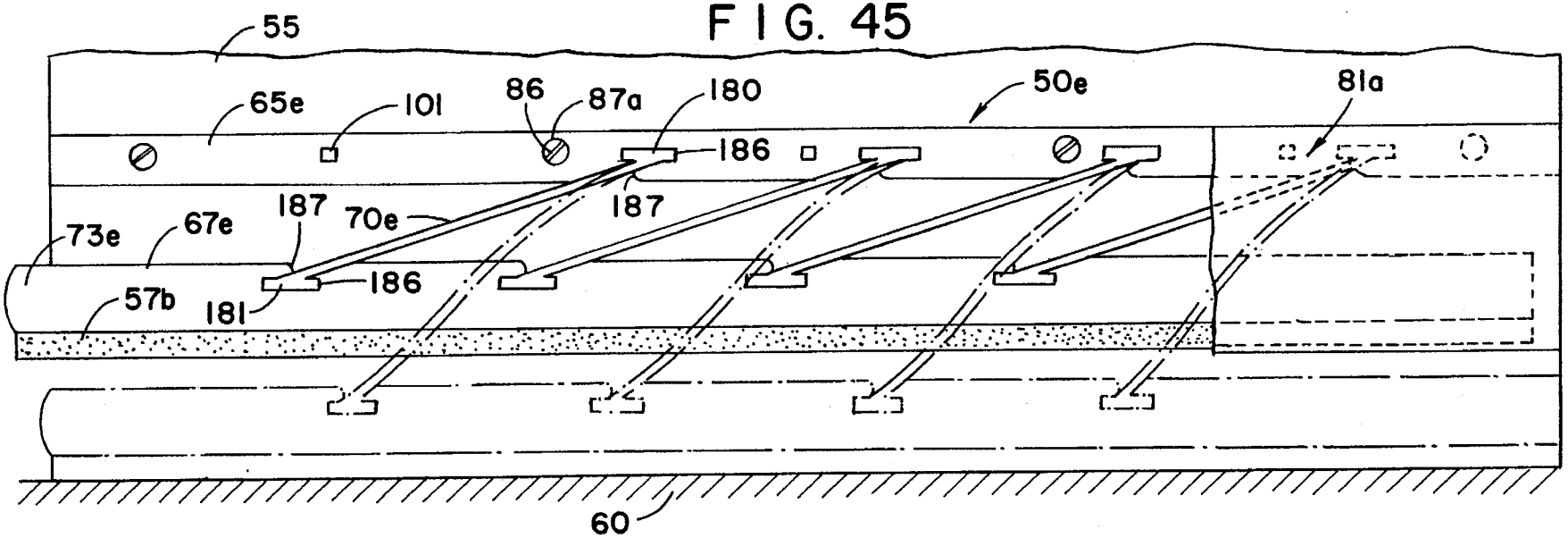
FIG. 45 is a front elevation view of the sealing device and door of FIG. 42 showing movement of the sealing element of the device from the projecting sealing position thereof in the retracted non-sealing contact with the floor (broken-lines) to position thereof above the floor (solid lines) when the door is opened.
Figure 46:
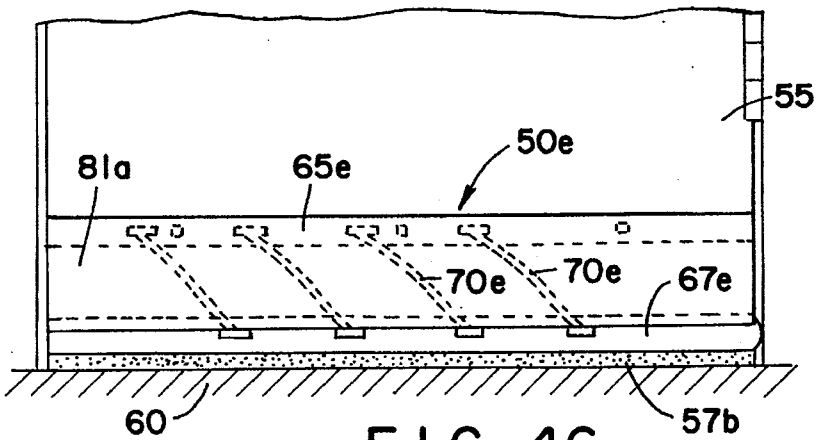
FIG. 46 is a front elevation view of the sealing device of FIG. 42 mounted to a right-opening door depicting the device in the closed position of the door.
Figure 44:
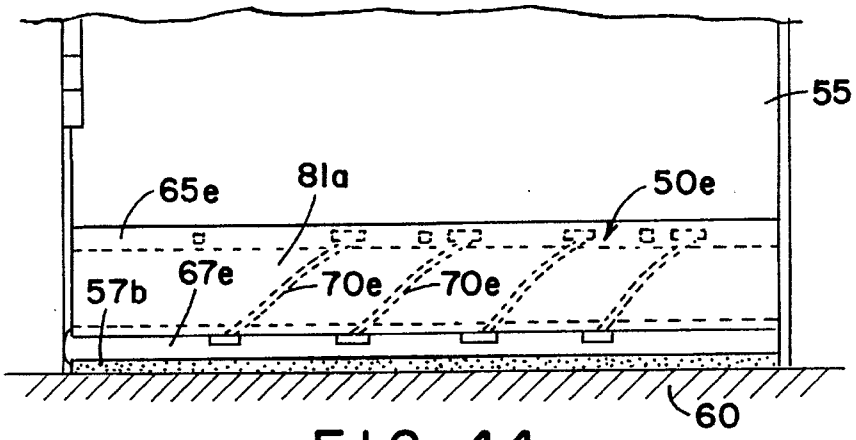
FIG. 44 is a front elevation view of the sealing device of FIG. 42 mounted to a left-opening door showing the sealing element of the device in its projecting sealing position in contact with the floor in the closed position of the door.

FIGS. 42–46 illustrate an embodiment of a sealing device 50*e* in which spring elements 70*e* are manufactured independently of, and not integrally connected to, support element 65*e* and seal actuating element 67*e*. Referring to FIG. 42, each spring element 70*e* is a strip having at its opposite ends structure which mates and engages with structure on support element 65*e* and seal actuating element 67*e* so as to support seal actuating element 67*e* from support element 65*e* as described above for sealing device 50. Each spring element 70*e* has shaped ends 180, 181, and support element 65*e* and seal actuating element 67*e* have correspondingly shaped slots or holes 184, 185 which receive shaped ends 180, 181, respectively. As shown in FIG. 42, ends 180, 181 of spring elements 70*e* are generally of rectangular cross-section, and extend at an angle to the central part of the spring elements 70*e*. Correspondingly, slots 184, 185 include a short section 186 extending at an angle to the respective support and seal actuating elements 65*e*, 67*e*, and a section 187 extending parallel to the longitudinal extent of the respective support and seal actuating element 65*e*, 67*e*. When support element 65*e* is mounted to a door 55, upper ends 180 of spring elements 70*e* are engaged in slots 184 of support element 65*e* and lower spring element ends 181 are engaged in slots 185. The configurations of shaped ends 180, 181 and shaped slots 184, 185 are such that spring elements 70*e* engage and are interlocked to support element 65*e* and seal actuating element 67*e* so as not to be displaced laterally when a lateral force is applied to seal actuating element 67*e*. Thus, the engaged and interlocked spring elements 70*e* impede free lateral movement of seal actuating element 67*e* relative to support element 65*e*, i.e., allow lateral movement of seal actuating element 67*e* only against the spring action of spring elements 70*e*, as described above for sealing device 50. FIG. 45 illustrates flexing of spring elements 70*e* of sealing device 50*e* mounted to a door 55 when a lateral force is applied to seal actuating element 67*e* by a cam element (not shown) as door 55 is closed. Spring elements 70*e*, support element 65*e* and seal actuating element 67*e* may be assembled as a unit on a flat surface, and then mounted as an assembly to door 55. Sealing device 50*e* may be used with left or right opening doors, as illustrated by FIGS. 44 and 46, as described above for sealing devices 50 and 50*a*. The particular shapes for ends 180, 181 of spring elements 70*e* and slots 184, 185 are not critical, and shapes other than those shown may achieve the interlocking and engaging functions described above.

Figure 47:
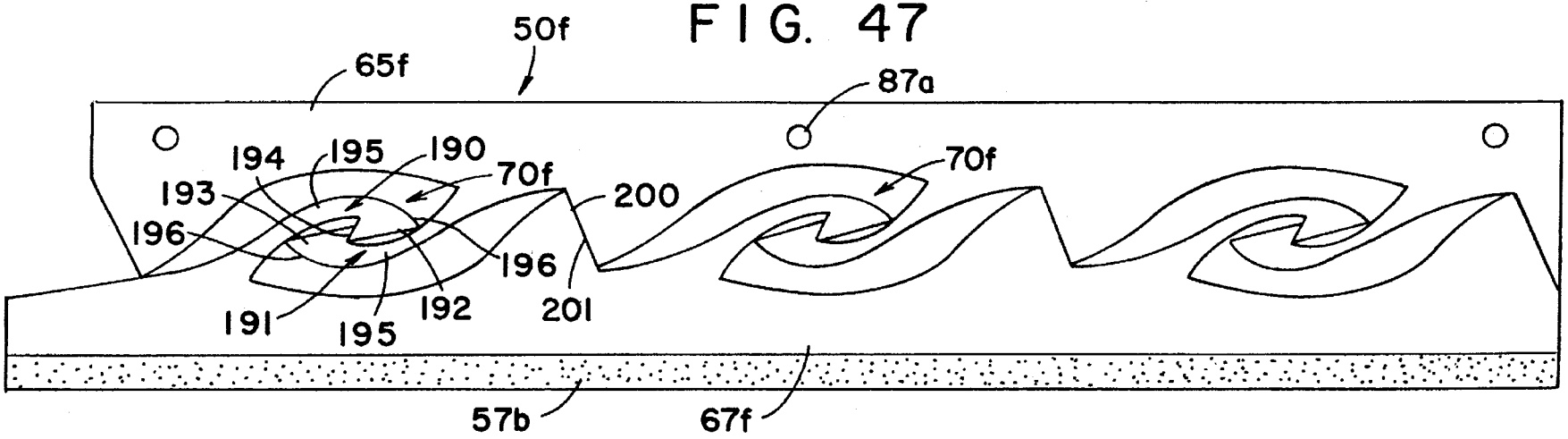
FIGS. 47 and 48 are front elevation views of another embodiment of a sealing device according to the invention having spring elements integrally attached to one or both elements of the sealing device.

The embodiments of sealing devices 50*f* and 50*g* illustrated in FIGS. 47 and 48 include spring element parts integrally attached to either or both of support element 65*f*, *g* or seal actuating element 67*f*, *g*, and interlocked as described below. Referring to FIG. 47, spring element 70*f* includes two parts 190, 191, part 191 of which is integrally attached to support element 65*f* and part 190 of which is attached to seal actuating element 67*f*. Providing spring element parts 191, 190 integral respectively with support element 65*f* and seal actuating element 67*f* enables sealing device 50*f* to be made in two parts. Spring element parts 190 and 191 each terminate in an end 192, 193, respectively, shaped to engage and interlock each other as shown in FIG. 47. Each shaped end 192, 193 is flared outwardly and includes a sharp angled portion 194 at which parts 190, 191 engage. Parts 190, 191 also include a curved portion 195 in contact with another edge 196 of shaped ends 192, 193. The parts 190, 191 of spring element 70*f* project at an angle from support element 65*f* and seal actuating element 67*f*. The configuration described above for spring elements 70*f* enables parts 190 and 191 to engage and interlock so as to support seal actuating element 67*f* from support element 65*f*, and provide the spring action described above for spring elements 70 of sealing device 50.

Referring to FIG. 47, each of support element 65*f* and seal actuating element 67*f* includes camming surfaces 200, 201, respectively, which function to assist spring elements 70*f* in providing movement of seal actuating element 67*f* towards and away from support element 65*f* in response to lateral movement of seal actuating element 67*f* by a cam element 75 (not shown in FIG. 47) against projecting end 73*f* of seal actuating element 67*f*. As seal actuating element 67*f* is urged to the right in FIG. 47, camming surface 200 forces camming surface 201 to ride along surface 201, which forces seal actuating element 67*f* downwardly.

Figure 48:
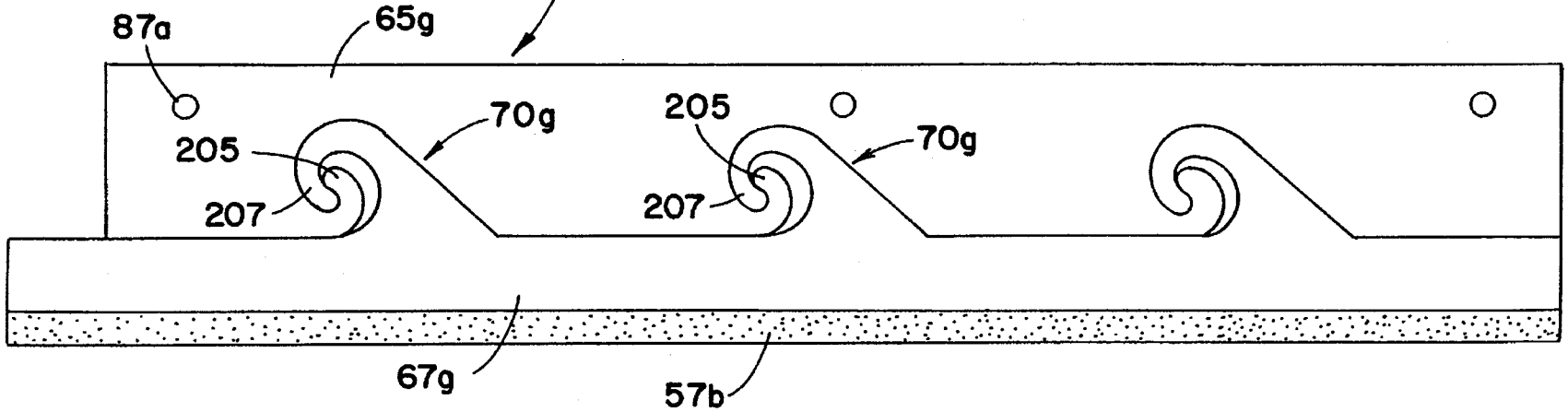

Referring to FIG. 48, sealing device 50*g* includes spring elements 70*g* integrally connected to seal actuating element 67*g* and projecting therefrom at an angle, and engaging structure 205 integrally connected to support element 65*g* (or the reverse). Spring elements 70*g* each include a shaped end 207 which is engaged in correspondingly shaped engaging structure 205 in seal actuating element 65*g*. Shaped ends 207 and engaging structure 205 engage and interlock as shown in FIG. 48 so as to support seal actuating element 67*g* from support element 65*g*, and provide the spring action described above for spring elements 70 of sealing device 50. Support element 65*g* and seal actuating element 67*g* also include camming surfaces 200, 201. Sealing device 50*g* operates generally as described for sealing device 50*f*. Engaging structure 205 may be flexible and so form a part of a respective spring element, or may be relatively rigid so that spring element 70*g* alone constitutes the spring element.

FIGS. 49 and 50 illustrate an embodiment of a sealing device which does not utilize a cam element and a projecting end to couple the seal actuating element to the door jamb. Instead, sealing device 50*h* shown in FIGS. 49 and 50 includes coupling means 210 comprising a flexible coupling member 211 in the form of a filament, cord, cable or wire attached at one end to door jamb 77 at 213 and at the other end to a hole 215 in a projection 216 on top of seal actuating element 67*h*. Sealing device 50*h* also includes V-shaped spring elements 70*h* which are configured to resiliently support seal actuating element 67*h* from support element 65*h* for movement of seal actuating element 67*h* towards and away from support element 65*h* while introducing substantially no lateral movement of seal actuating element 67*h* with respect to support element 65*h*. Spring elements 70*h* comprise a portion 220 extending at an angle from support element 65*h* and a portion 221 extending at substantially the same angle from seal actuating element 67*h*, with the portions 220, 221 meeting at a vertex to form a V-shaped spring element. Spring element portions 220, 221 extend from support element 65*h* and seal actuating element 67*h* and are joined at their free ends such that seal actuating element 67*h* may move towards and away from support element 65*h* while the spring element portions 220, 221 substantially prevent lateral movement of seal actuating element 67*h*.

In operation, with door 55 closed (FIG. 49), seal actuating element 67*h* urges sealing element 57 into contact with floor 60 with a slight slack in cord 211. As door 55 is opened, the slack in cord 211 is quickly taken up and continued opening of door 55 lifts seal actuating element 67*h* and tensions spring elements 70*h*, as shown in FIG. 50. When door 55 is closed to the point that there is some slack in cord 211, spring elements 70*h* relax and force seal actuating element 67*h* downwardly to take up the slack until door 55 is fully closed, as shown in FIG. 49.

Sealing device 50*h* is mounted to the interior of a door 55 as generally described for sealing device 50 and provides the desired spring tension in the closed position of door 55 illustrated in FIG. 49. Then cord 211 is attached to hole 215 and to door jamb 77 at 213 with a slight slack in the cord. Since sealing device 50*h* does not require a cam element, it may be mounted to left-or right-opening doors, and to the inside and the outside of doors without having to consider placement of a cam element.

Spring elements 70*h* may be separate pieces connected to support element 65*h* and seal actuating element 67*h* as described above. Or spring elements 70*h* may each have a strip 220, 221 integrally attached to support element 65*h* and seal actuating element 67*h*, respectively, and coupled together.

Sealing device 50*h* may have pre-weakened portions (not shown) at one end thereof so that sealing device 50*h* may be reduced in size as described above for smaller openings. When pre-weakened portions are provided at one end of device 50*h*, the V-shaped spring elements 70*h* are not symmetrically located about the center of sealing device 50*h* which is then longer on the end with the pre-weakened portions. This allows a substantial length of sealing device 50*h* to be severed without severing a spring element 70*h*. If a smaller adjustment range is acceptable, then sealing device 50*h* may have pre-weakened portions at both ends with the V-shaped springs being symmetrically positioned. Sealing device 50*h* may then be shortened at either or both ends.

The spring elements 70*h* of sealing device 50*h* are unstressed in the closed position of door 55, and sealing device 50*h* is molded with the springs extended and unstressed ("molded long"). Sealing device 50*h* in the closed position of the door is attached with only a slight stress on spring elements 70*h* sufficient to force sealing element 57 into positive contact with the floor. Spring elements 70*h* are effectively stressed only when the door is open, which accounts for relatively short periods of time in comparison to the time the door is closed. As mentioned above, the embodiment of sealing device 50*h* has an advantage over the embodiment of FIG. 1 in which the spring elements are stressed in the closed position of the door in that a sealing device such as device 50*h* in which the spring elements are usually unstressed will have a longer service life than a device such as device 50 in which the spring elements are usually stressed.

Sealing devices 50*c–h* each have a cover element (not shown) identical or similar to cover 81 or 81*a* of sealing device 50 or 50*a*, which may be mounted to sealing device 50*c–g*, as described for sealing devices 50 and 50*a*. Cover 81*h* for sealing device 50*h* (FIGS. 49 and 50) is mounted to door 55 by the same screws 86 which attach support element 65*h* to door 55. Also, sealing devices 50*c–g* may be mounted as respective assemblies using spacer elements 90 or 90*a* as described for sealing devices 50 and 50*a*. Sealing devices 50*c–h* may be used with left or right opening doors and may have weakened portions (not shown) for adjusting the length of sealing device 50*c–h* as described above for sealing device 50*a*. Sealing devices 50*c–h* may be made of materials as described for sealing device 50.

While the invention has been described and illustrated in connection with preferred embodiments, many variations and modifications as will be evident to those skilled in this art may be made without departing from the spirit and scope of the invention. For example, sealing devices may be provided with different cam elements or bearing elements depending upon the particular application and mounting location. Also, cam elements may be provided with different cam surfaces depending upon the particular application, and different mechanisms may be provided for adjusting the cam elements. Further, the sealing devices (including the spring elements) may be made from different materials consistent with the functions that the different parts of the sealing device are to perform and the long service life desired. For the OEM market, the sealing devices may be provided without the capability for length adjustment since they will be manufactured for use with a particular closure. The sealing element may have various profiles and be replaceably attached to the seal actuating element in various ways, or may be integrally connected to the seal actuating element possibly by being molded therewith. Also, many parts may be reversed relative to other parts. For example, a cam element may be connected to the seal actuating element and a projection may be provided on the door jamb, and the locations of respective parts for slide-fitting or snap-fitting the cover to the support element may be reversed. The invention as set forth in the appended claims is thus not to be limited to the precise details of construction set forth above as such variations and modifications are intended to be included within the spirit and scope of the invention as defined in the appended claims.

What is claimed is:

1. An automatically actuated sealing device for sealing a portion of a movable closure member such as a door or window with respect to a surface to be sealed which defines part of an opening closed by the closure member, comprising:

an elongated support element attachable to the closure member;

an elongated seal actuating element;

a plurality of spaced spring elements extending between and connecting said support element and said seal actuating element such that said support element resiliently supports said seal actuating element for movement relative to said support element towards and away from said support element;

at least a portion of at least two of said spring elements forming an integral, one piece member with said supporting element or said seal actuating element or both;

a sealing element mounted to said device in engagement with said seal actuating element so as to move with movement of said seal actuating element, said sealing element having an exposed end portion positioned opposite said support element, which said actuating element moves towards and away from said support element; and means for coupling said seal actuating element to a surface adjacent the closure member and relative to which the closure member moves such that in cooperation with said spring elements said seal actuating element moves relative to said support element between a retracted position in which said sealing element is retracted towards said support element and a projecting position in which said seal actuating element is projected away from said support element in response to movement of the closure member, whereby when said device is mounted to the closure member, in the closed position of the closure member said seal actuating element moves said sealing element into its projecting position in which said sealing element engages the surface to be sealed and in a position of the closure member other than the closed position said seal actuating element moves said sealing element into its retracted position in which said sealing element does not engage the surface to be sealed.

2. The device of claim 1 wherein said at least two spring elements include a portion forming an integral, one-piece member with said support element, a portion forming an integral, one-piece member with said seal actuating element, and means for engaging respective spring element portions extending from said support element and said seal actuating element.

3. The device of claim 1 wherein said at least two spring elements are integrally joined to both said support element and said seal actuating element such that said support element, said seal actuating element and said plurality of spring elements form an integral one-piece member.

4. The device of claim 1 wherein said spring elements upon lateral movement of said seal actuating element in one direction cause said seal actuating element to move away from said support element, and upon lateral movement in an opposite direction cause said seal actuating element to move towards said support element; and wherein said means for coupling and said spring elements cooperate to laterally move said seal actuating element between the retracted position and the projecting position.

5. The device of claim 4 wherein said means for coupling comprises a projection on said seal actuating element adapted to be engaged by the surface adjacent the closure member in the closed position of the closure member to cause said seal actuating element to be laterally moved in the one direction into the projecting position thereof, and adapted not to be engaged by the the surface adjacent the closure member when the closure member is moved from the closed position thereof to cause said seal actuating element to be moved in the opposite lateral direction to the retracted position thereof.

6. The device of claim 5 comprising a cam element either on said projection, or coupled to the surface adjacent the closure member, for camming said seal actuating element to progressively move said seal actuating element in the one and opposite lateral directions as the closure member is moved into and out of its closed position.

7. The device of claim 6 wherein said cam element has a surface extending in a first direction so as to cam said seal actuating element laterally and in a second direction so as to cam said seal actuating element towards and away from said support element.

8. The device of claim 1 wherein said plurality of spring elements are configured and connected to direct movement of said seal actuating member towards and away from said support element and restrain lateral movement of said seal actuating element, and wherein said means for coupling and said spring elements cooperate to move said seal actuating element towards and away from said support element with substantially no lateral movement of said seal actuating element.

9. The device of claim 8 wherein said means for coupling comprises an elongated flexible element attached to said seal actuating element and attachable to the surface adjacent the closure member so as to move said seal actuating element from said projecting position to said retracted position when the closure member is moved out of its closed position, said spring elements moving said seal actuating element into its projecting position when the closure member is moved into its closed position.

10. The device of claim 1 comprising means for attaching said support element on an outer surface of said closure member, and a cover covering all of said support element and all or substantially all of said seal actuating element while permitting movement of said seal actuating element, and means for attaching said cover to said closure member.

11. The device of claim 10 wherein said means for attaching said cover comprises a plurality of holes in said cover positioned to be in alignment with holes in said support element and a plurality of fasteners.

12. The device of claim 10 wherein said means for attaching said support element to the closure member comprises a plurality of holes in said support element and a plurality of fasteners which pass through said holes and are affixed to said closure member.

13. The device of claim 12 wherein said means for attaching said cover comprises mating projecting structure and recessed structure on said cover and said support element which slidably engage.

14. The device of claim 12 wherein said means for attaching said cover comprises projecting structure and receptacle structure on said cover and said support element, said projecting structure snap fitting into said receptacle structure.

15. The device of claim 1 comprising a channel member for attaching said support element internally of said closure member, means for attaching said support element within said channel member while permitting movement of said seal acutating element, and means for attaching said channel member internally of said closure member.

16. The device of claim 15 wherein said means for attaching said support element to said channel member comprise holes and fasteners.

17. An automatically actuated sealing device for sealing a portion of a movable closure member such as a door or window with respect to a surface to be sealed which defines part of an opening closed by the closure member, comprising:

an elongated support element attachable to the closure member;

an elongated seal actuating element;

a plurality of flexible strips;

each of said strips and a same side of said support element having interlocking structure for attaching without the use of fasteners one end of each of said strips to said same side of said support element at spaced locations on said elongated support element with said strips projecting transversely from said same side of said support element;

each of said strips and a same side of said seal actuating element having interlocking structure for connecting without the use of fasteners an opposite end of each of said strips to said same side of said seal actuating element at spaced locations on said support element with said strips projecting transversely from said same side of said seal actuating element, such that when said support element is attached to the closure member and said strips are interlocked with both said support element and said seal actuating element said support element resiliently supports said seal actuating element for movement relative to said support element towards and away from said support element;

a sealing element mounted to said device in engagement with said seal actuating element so as to move with movement of said seal actuating element, said sealing element having an exposed end portion positioned opposite said support element, which said actuating element moves towards and away from said support element; and means for coupling said seal actuating element to a surface adjacent the closure member and relative to which the closure member moves such that in cooperation with said strips said seal actuating element moves relative to said support element between a retracted position in which said sealing element is retracted towards said support element and a projecting position in which said seal actuating element is projected away from said support element in response to movement of the closure member, whereby when said device is mounted to the closure member, in the closed position of the closure member said seal actuating element moves said sealing element into its projecting position in which said sealing element engages the surface to be sealed and in a position of the closure member other than the closed position said seal actuating element moves said sealing element into its retracted position in which said sealing element does not engage the opening surface to be sealed.

18. The device of claim 17 wherein said strips are configured and engaged such that lateral movement of said seal actuating element in one direction moves said seal actuating element away from said support element and lateral movement in an opposite direction moves said seal actuating element towards said support element; and wherein said means for coupling and said strips cooperate to laterally move said seal actuating element between the retracted position and the projecting position.

19. The device of claim 17 wherein said means for coupling comprises a projection on said seal actuating element adapted to be engaged by the surface adjacent the closure member in the closed position of the closure member to cause said seal actuating element to be laterally moved in the one direction into the projecting position thereof, and adapted not to be engaged by the surface adjacent the closure member when the closure member is moved from the closed position thereof to cause said seal actuating element to be moved in the opposite lateral direction to the retracted position thereof.

20. The device of claim 19 comprising a cam element either on said projection or coupled to the surface adjacent the closure member to be engaged by said projection for camming said seal actuating element to progressively move said seal actuating element in the one and opposite lateral directions as the closure member is moved into and out of its closed position.

21. The device of claim 20 wherein said cam element has a surface extending in a first direction so as to cam said seal actuating element laterally and in a second direction so as to cam said seal actuating element towards and away from said support element.

22. The device of claim 17 wherein said strips are made of plastic material.

23. The device of claim 17 wherein each of said strips at opposite ends thereof have a laterally projecting portion, and wherein said support element and said seal actuating element each have recesses for receiving said projections in an interlocking fashion whereby said strips may be connected to said support element and said seal actuating element without fasteners.

24. An automatically actuated sealing device for sealing a portion of a movable closure member such as a door or window with respect to a surface to be sealed which defines part of an opening closed by the closure member, comprising:

an elongated support element attachable to the closure member;

an elongated seal actuating element;

a plurality of spaced spring elements connected at opposite ends to said support element and said seal actuating element such that said support element resiliently supports said seal actuating element for resilient movement relative to said support element, said spring elements being configured and attached to said support element and said seal actuating element to direct movement of said seal actuating element towards and away from said support element and restrain lateral movement of said seal actuating element;

a sealing element mounted to said device in engagement with said seal actuating element so as to move with movement of said seal actuating element, said sealing element having an exposed end portion positioned opposite said support element, which said actuating element moves towards and away from said support element; and means for coupling said seal actuating element to a surface adjacent the closure member and relative to which the closure member moves to move said seal actuating element relative to said support element with substantially no lateral movement of said seal actuating element relative to said support element between a retracted position in which said sealing element is retracted towards said support element and a projecting position in which said seal actuating element is projected away from said support element in response to movement of the closure member, whereby when said device is mounted to the closure member, in the closed position of the closure member said seal actuating element moves said sealing element into its projecting position in which said sealing element engages the surface to be sealed and in a position of the closure member other than the closed position said seal actuating element moves said sealing element into its retracted position in which said sealing element does not engage the surface to be sealed.

25. The device of claim 24 wherein said means for coupling comprises an elongated flexible element connected to said seal actuating element and attachable to the surface adjacent the closure so as to move said seal actuating element from its projecting position to its retracted position when the closure member is moved out of its closed position, said spring elements moving said seal actuating element into its projecting position when the closure member is moved into its closed position.

26. An automatically actuated sealing device for sealing a portion of a movable closure member such as a door or window with respect to a surface to be sealed which defines part of an opening closed by the closure member, comprising:

a one-piece member comprising an elongated support element attachable to the closure member, an elongated seal actuating element and a plurality of spaced spring elements connected at opposite ends to said support element and said seal actuating element such that said support element resiliently supports said seal actuating element for movement relative to said support element laterally and towards and away from said support element, lateral movement of said seal actuating element in one direction moving said seal actuating element away from said support element and lateral movement in an opposite direction moving said seal actuating element towards said support element;

a sealing element mounted to said device in engagement with said seal actuating element so as to move with movement of said seal actuating element, said sealing element having an exposed end portion positioned opposite said support element, which said actuating element moves towards and away from said support element;

said spring elements and a means for coupling said seal actuating element to a surface adjacent the closure member and relative to which the closure member moves such that in cooperation with said seal actuating element laterally moves between a retracted position in which said sealing element is retracted towards said support element and a projecting position in which said seal actuating element is projected away from said support element in response to movement of the closure member, whereby when said device is mounted to the closure member, in the closed position of the closure member said seal actuating element moves said sealing element into its projecting position in which said sealing element engages the surface to be sealed and in a position of the closure member other than the closed position said seal actuating element moves said sealing element into its retracted position in which said sealing element does not engage the surface to be sealed.

27. An automatically actuated sealing device for sealing a portion of a movable closure member such as a door or window with respect to a surface which defines part of an opening closed by the closure member, comprising:

a first one-piece member comprising an elongated support element attachable to the closure member and a plurality of spaced first spring elements attached at one end to said support element and projecting transversely therefrom a second one piece member comprising a seal actuating element and a second plurality of spaced spring elements connected at one end to said support element and projecting transversely therefrom;

each of said first projecting spring elements connected to said support element and each of said second projecting spring elements attached to said seal actuating element having interlocking structure for connecting without the use of fasteners a respective first spring element to a respective second spring element such that when said support element is attached to the closure member and said respective first and second spring elements are interlocked, said support element resiliently supports said seal actuating element for lateral resilient movement relative to said support element, said first and second spring elements being configured and engaged such that lateral movement of said seal actuating element in one direction moves said seal actuating element away from said support element and lateral movement in an opposite direction moves said seal actuating element towards said support element;

a sealing element mounted to said device in engagement with said seal actuating element member so as to move with movement of said seal actuating element, said sealing element having an exposed end portion positioned opposite said support element, which said actuating element moves towards and away from said support element; and means for coupling said seal actuating element to a surface adjacent the closure and relative to which the closure moves such that in cooperation with with said spring elements said seal actuating element laterally moves relative to said support element between a retracted position in which said sealing element is retracted towards said support element and a projecting position in which said seal actuating element is projected away from said support element in response to movement of the closure member, whereby when said device is mounted to the closure member, in the closed position of the closure member said seal actuating element moves said sealing element into its projecting position in which said sealing element engages the surface to be sealed and in a position of the closure member other than the closed position said seal actuating element moves said sealing element into its retracted position in which said sealing element does not engage the surface to be sealed.

28. An automatically actuated sealing device for sealing a portion of a movable closure member such as a door or window with respect to a surface which defines part of an opening closed by the closure member, comprising:

a one-piece member comprising an elongated support element attachable to the closure member and a plurality of spaced spring elements connected at one end to said support element and projecting transversely therefrom;

an elongated seal actuating element;

each of said projecting spring elements connected to said support element having interlocking structure for connecting without the use of fasteners said spring elements to said seal actuating element such that when said support element is attached to the closure member and said spring elements are interlocked with said seal actuating element, said support element resiliently supports said seal actuating element for lateral resilient movement relative to said support element, said spring elements being configured and interlocked with said seal actuating element such that lateral movement of said seal actuating element in one direction moves said seal actuating element away from said support element and lateral movement in an opposite direction moves said seal actuating element towards said support element;

a sealing element mounted to said device in engagement with said seal actuating element member so as to move with movement of said seal actuating element, said sealing element having an exposed end portion positioned opposite said support element, which said actuating element moves towards and away from said support element; and means for coupling said seal actuating element to a surface adjacent the closure and relative to which the closure moves such that in cooperation with with said spring elements said seal actuating element laterally moves relative to said support element between a retracted position in which said sealing element is retracted towards said support element and a projecting position in which said seal actuating element is projected away from said support element in response to movement of the closure member, whereby when said device is mounted to the closure member, in the closed position of the closure member said seal actuating element moves said sealing element into its projecting position in which said sealing element engages the the surface to be sealed and in a position of the closure member other than the closed position said seal actuating element moves said sealing element into its retracted position in which said sealing element does not engage the opening the surface to be sealed.

29. An automatically actuated sealing device for sealing a portion of a movable closure member such as a door or window with respect to a surface which defines part of an opening closed by the closure member, comprising:

an elongated support element attachable to the closure member;

a one-piece member comprising an elongated seal actuating element and a plurality of spaced spring elements connected at one end to said seal-actuating element and projecting transversely therefrom;

each of said projecting spring elements attached to said seal actuating element having interlocking structure for connecting without the use of fasteners said spring elements to said support element such that when said support element is attached to the closure member and said spring elements are interlocked with said support element, said support element resiliently supports said seal actuating element for lateral resilient movement relative to said support element, said spring elements being configured and interlocked with said support element such that lateral movement of said seal actuating element in one direction moves said seal actuating element away from said support element and lateral movement in an opposite direction moves said seal actuating element towards said support element;

a sealing element mounted to said device in engagement with said seal actuating element member so as to move with movement of said seal actuating element, said sealing element having an exposed end portion positioned opposite said support element which said actuating element moves towards and away from said support element; and means for coupling said seal actuating element to a surface adjacent the closure and relative to which the closure member moves such that in cooperation with said spring elements said seal actuating element is laterally moved between a retracted position in which said sealing element is retracted towards said support element and a projecting position in which said seal actuating element is projected away from said support element in response to movement of the closure member, whereby when said device is mounted to the closure member, in the closed position of the closure member said seal actuating element moves said sealing element into its projecting position in which said sealing element engages the the surface to be sealed and in a position of the closure member other than the closed position said seal actuating element moves said sealing element into its retracted position in which said sealing element does not engage the the surface to be sealed.

30. The device of claim 29 wherein said one-piece member is made entirely of plastic material.

31. The device of claim 29 wherein said means for coupling comprises a projection on said seal actuating element adapted to be engaged by the surface adjacent the closure in the closed position of the closure member to cause said seal actuating element to be laterally moved in the one direction into the projecting position thereof, and adapted not to be engaged by the surface adjacent the closure when the closure member is moved from the closed position thereof to cause said seal actuating element to be moved in the opposite lateral direction to the retracted position thereof.

32. The device of claim 31 comprising a cam element either on said projection or connected to the surface adjacent the closure to be engaged by said projection for camming said seal actuating element to progressively move said seal actuating element in the one and opposite lateral directions as the closure member is moved into and out of its closed position.

33. The device of claim 32 wherein said cam element has a surface extending in a first direction so as to cam said seal actuating element laterally and in a second direction so as to cam said seal actuating element towards and away from said support element.

34. An automatically actuated sealing device for sealing a portion of a movable closure member such as a door or window with respect to a surface to be sealed which forms part of an opening closed by the closure member, comprising:

an elongated support element attachable to the closure member;

an elongated seal actuating element;

means for coupling said support element and said seal actuating element for movement of said seal actuating element relative to said support element;

a sealing element mounted to said device in engagement with said seal actuating element so as to move with movement of said seal actuating element, said sealing element having an exposed end portion positioned opposite said support element, which said actuating element moves towards and away from said support element;

said means for coupling and said seal actuating element having a plurality of laterally spaced, aligned weakened portions adjacent at least one end of said device by means of which portions of said support element, said means for coupling and said seal actuating element defined by said aligned weakened portions may easily be severed from said device by stressing, cutting or the like along said aligned weakened portions, whereby said device may easily be sized for use with a particular opening and closure member.

35. The device of claim 34 wherein said support element, said means for coupling and said seal actuating element are made entirely of plastic material.

36. An automatically actuated sealing device for sealing a portion of a movable closure member such as a door or window with respect to a surface to be sealed which defines part of an opening closed by the closure member, comprising:

an elongated support element attachable to the closure member;

an elongated seal actuating element;

means for coupling said support element and said seal actuating element for movement of said seal actuating element relative to said support element;

a sealing element mounted to said device in engagement with said seal actuating element so as to move with movement of said seal actuating element, said sealing element having an exposed end portion positioned opposite said support element, which said actuating element moves towards and away from said support element; and said seal actuating element comprising a plurality of members extending laterally relative to said support element flexibly interconnected such that at least one of said members of said seal actuating element may move relative to an adjacent member, whereby when said closure member is in its closed position, said seal actuating element may move said sealing element into sealing engagement with an inclined or uneven surface to be sealed.

37. An automatically actuated sealing device for sealing a portion of a movable closure member such as a door or window with respect to a surface to be sealed which defines part of an opening closed by the closure member, comprising:

an elongated support element attachable to the closure member;

an elongated seal actuating element;

means for coupling said support element and said seal actuating element for movement of said seal actuating element relative to said support element;

a sealing element mounted to said device in engagement with said seal actuating element so as to move with movement of said seal actuating element, said sealing element having an exposed end portion positioned opposite said support element, which said actuating element moves towards and away from said support element; and said support element and said seal actuating element including at at least one end thereof means for connecting thereto another said support element and another said seal actuating element, respectively, whereby the length of said device may be extended.

38. The device of claim 37 wherein said means for connecting comprises a recess in each said end of said support element and said seal actuating element for receiving and engaging a mating projection attached to another support element and seal actuating element, respectively.

39. The device of claim 38 wherein said means for connecting comprises projections in each said end of said support element and said seal actuating element to be received in recesses in the other support element and the other seal actuating element.

40. An automatically actuated sealing device for sealing a portion of a movable closure member such as a door or window with respect to a surface to be sealed which defines part of an opening closed by the closure member, comprising:

an elongated support element attachable to the closure member;

an elongated seal actuating element;

means for coupling said support element and said seal actuating element for movement of said actuating element relative to said support element;

a sealing element mounted to said device in engagement with said seal actuating element so as to move with movement of said seal actuating element, said sealing element having an exposed end portion positioned opposite said support element, which said actuating element moves towards and away from said support element; and means for holding said seal actuating element a predetermined distance from said support element during installation of said device on said closure member.

41. The device of claim 40 wherein said means for holding comprises a spacer element pivotally connected either to said support element or to said seal actuating element and at least one stop on said seal actuating element or said support element, respectively, which said spacer element engages to space said seal actuating element the predetermined distance from said support element.

42. The device of claim 40 wherein said means for holding comprises a plurality of holes in said support element and in said seal actuating element positioned so that at least two holes in said support element are aligned respectively with at least two holes in said seal actuating element, and a plurality of spacer elements each having a pair of spaced projections configured to be received and engaged in respective aligned holes in said support element and said seal actuating element, the spacing of said projections defining the predetermined distance.

43. An automatically actuated sealing device for sealing a portion of a movable closure member such as a door or window with respect to a surface to be sealed which defines part of an opening closed by the closure member, comprising:

an elongated seal actuating element;

means for resiliently coupling said seal actuating element to the closure member for lateral movement of said seal actuating element relative to the closure member, lateral movement of said seal actuating element in one direction moving said seal actuating element away from the closure member and lateral movement in an opposite direction moving said seal actuating element towards the closure member;

a sealing element mounted to said device in engagement with said seal actuating element member so as to move with movement of said seal actuating element, said sealing element having an exposed end portion which said actuating element moves towards and away from the closure member;

a projection on said seal actuating element and a cam element connectable to a surface adjacent the closure and relative to which the closure moves and adapted to be engaged by said projection in the closed position of the closure member to cause said seal actuating element to be laterally moved in one direction relative to the closure member, and adapted not to be engaged by said cam element when the closure member is moved from the closed position thereof to cause said seal actuating element to be laterally moved in a direction opposite to said one direction;

said cam element having a surface extending in a first direction so as to cam said seal actuating element laterally and in a second direction so as to cam said seal actuating element towards and away from the closure member;

whereby when the device is mounted to the closure member, said means for resiliently coupling, said projection and said cam element cooperate to laterally move said seal actuating element between a retracted position in which said sealing element is retracted towards the closure member and a projecting position in which said seal actuating element is projected away from the closure member in response to movement of the closure member.

44. The device of claim 43 wherein said means for coupling said seal actuating element to the closure member comprise an elongated support element, a plurality of spring elements, means for connecting said spring elements to said support element and and to said seal actuating element, and means for connecting said support element to said closure.

45. In a device attachable to a closure such as a door or window on an exterior side thereof for automatically sealing an edge of the closure to a surface of the opening closed by the closure, said device including means for moving a sealing element into contact with the surface of the opening when the door is moved to close the opening and for moving the sealing element away from the surface when the closure is moved to open the opening;

a cover for covering said device and means on said device and said cover for snap-fitting said cover to said device.

46. In a device attachable to a closure such as a door or window on an exterior side thereof for automatically sealing an edge of the closure to a surface of the opening closed by the closure, said device including means for moving a sealing element into contact with the surface of the opening when the door is moved to close the opening and for moving the sealing element away from the surface when the closure is moved to open the opening;

a cover for covering said device and means on said device and said cover which engage when said cover is slid onto said device.

47. In a device attachable to a closure such as a door or window on an exterior side thereof for automatically sealing an edge of the closure to a surface of the opening closed by the closure, said device including means for moving a flexible sealing element into contact with the surface of the opening when the door is moved to close the opening and for moving the sealing element away from the surface when the closure is moved to open the opening;

the improvement comprising an additional device including a sealing element and means for moving said sealing element into contact with and away from the opening surface when the closure is respectively moved to close and open the opening, and means for connecting said additional device to said device end-to-end.

48. The device of claim 47 wherein said device and said additional device are connected such that said device couples movement of said sealing element thereof to said means for moving of said additional device.

* * * * *